US009839261B2

(12) United States Patent
Hatfield et al.

(10) Patent No.: US 9,839,261 B2
(45) Date of Patent: Dec. 12, 2017

(54) EASY ACCESS ARTICLES OF FOOTWEAR

(71) Applicant: NIKE, Inc., Beaverton, OR (US)

(72) Inventors: Tobie D. Hatfield, Lake Oswego, OR (US); Richard Ramsay, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/334,594

(22) Filed: Oct. 26, 2016

(65) Prior Publication Data

US 2017/0042290 A1 Feb. 16, 2017

Related U.S. Application Data

(63) Continuation-in-part of application No. 15/000,438, filed on Jan. 19, 2016, which is a continuation of application No. 13/744,052, filed on Jan. 17, 2013, now Pat. No. 9,265,305.

(51) Int. Cl.
*A43C 11/00* (2006.01)
*A43C 11/14* (2006.01)
(Continued)

(52) U.S. Cl.
CPC ..... *A43C 11/008* (2013.01); *A43B 3/02* (2013.01); *A43B 3/06* (2013.01); *A43B 3/08* (2013.01);
(Continued)

(58) Field of Classification Search
CPC ... A43C 11/1493; A43C 11/008; A43C 11/12; A43C 11/22; A43B 3/06; A43B 3/08; A43B 11/00
(Continued)

(56) References Cited

U.S. PATENT DOCUMENTS 2,302,596 A * 11/1942 Bigio ..... A43B 3/24 36/101
2,330,224 A 9/1943 L'Hollier
(Continued)

FOREIGN PATENT DOCUMENTS

DE 534443 C 9/1931
DE 8203280 U1 11/1982
(Continued)

OTHER PUBLICATIONS

International Search Report for PCT/US2014/011999 dated May 14, 2014.
(Continued)

*Primary Examiner* — Ted Kavanaugh
(74) *Attorney, Agent, or Firm* — Banner & Witcoff, Ltd.

(57) ABSTRACT

Footwear, including athletic footwear, opens very wide, e.g., by moving an ankle containing portion of a footwear upper laterally/sideways with respect to the sole structure or a base portion of the upper (e.g., rotate it to the lateral side). In effect, the ankle containing portion may move/rotate sideways with respect to the sole structure/base portion via a connecting member (e.g., moving akin to rotation on a hinge type structure) to open in somewhat of a "clamshell" fashion. The rear of the upper base portion in this open condition may appear somewhat as an open backed slipper or "slide" type shoe. These actions and features open the rear heel area of the upper wide and low to enable easy insertion of a foot into the interior chamber, generally from the rear of the footwear structure. One or more straps can be used to secure the upper to the foot.

20 Claims, 23 Drawing Sheets

(51) Int. Cl.

| | |
|---|---|
| ***A43C 11/16*** | (2006.01) |
| ***A43B 23/02*** | (2006.01) |
| ***A43C 11/12*** | (2006.01) |
| ***A43B 5/00*** | (2006.01) |
| ***A43B 3/02*** | (2006.01) |
| ***A43C 1/00*** | (2006.01) |
| ***A43C 11/22*** | (2006.01) |
| ***A43B 3/06*** | (2006.01) |
| ***A43B 3/08*** | (2006.01) |
| ***A43B 11/00*** | (2006.01) |
| ***A43B 23/00*** | (2006.01) |
| ***A43C 9/00*** | (2006.01) |

(52) U.S. Cl.
CPC ..... *A43B 5/00* (2013.01); *A43B 11/00* (2013.01); *A43B 23/00* (2013.01); *A43B 23/0245* (2013.01); *A43C 1/00* (2013.01); *A43C 9/00* (2013.01); *A43C 11/12* (2013.01); *A43C 11/14* (2013.01); *A43C 11/1493* (2013.01); *A43C 11/165* (2013.01); *A43C 11/22* (2013.01)

(58) Field of Classification Search
USPC ..... 36/138, 50.1, 112
See application file for complete search history.

(56) References Cited

U.S. PATENT DOCUMENTS

| | | | | |
|---|---|---|---|---|
| 4,079,527 | A | 3/1978 | Antonious | |
| 4,628,622 | A | 12/1986 | McBarron | |
| 4,665,634 | A * | 5/1987 | Diaz | A43B 3/30 36/112 |
| 4,706,392 | A | 11/1987 | Yang | |
| 6,941,683 | B2 | 9/2005 | Freed | |
| 7,607,242 | B2 * | 10/2009 | Karandonis | A43B 1/0081 36/105 |
| D635,746 | S | 4/2011 | Cofinco | |
| 9,265,305 | B2 | 2/2016 | Hatfield et al. | |
| 2008/0168683 | A1 | 7/2008 | Keating | |
| 2008/0229613 | A1 | 9/2008 | Park | |
| 2009/0100717 | A1 | 4/2009 | Cabanis | |
| 2011/0113650 | A1 | 5/2011 | Hurd et al. | |
| 2011/0296711 | A1 | 12/2011 | Nelson et al. | |
| 2012/0011744 | A1 | 1/2012 | Bell et al. | |
| 2012/0079746 | A1 * | 4/2012 | Ferreira | A43B 11/00 36/105 |
| 2012/0198720 | A1 | 8/2012 | Farris et al. | |
| 2016/0128429 | A1 | 5/2016 | Hatfield et al. | |
| 2016/0270484 | A1 * | 9/2016 | Zadnik | A43B 23/0205 |

FOREIGN PATENT DOCUMENTS

| | | | |
|---|---|---|---|
| JP | H10-57112 | A | 3/1998 |
| WO | 2005029991 | A1 | 4/2005 |

OTHER PUBLICATIONS

Non Final Office Action dated Aug. 10, 2015 in U.S. Appl. No. 13/744,052.

Nov. 2, 2015—U.S. Notice of Allowance—U.S. Appl. No. 13/744,052.

* cited by examiner

EASY ACCESS ARTICLES OF FOOTWEAR

RELATED APPLICATION DATA

This application is a continuation-in-part of and claims priority to (a): U.S. patent application Ser. No. 15/000,438, filed Jan. 19, 2016 and entitled "Easy Access Articles of Footwear," which application is a continuation of (b) U.S. patent application Ser. No. 13/744,052 filed Jan. 17, 2013 and entitled "Easy Access Articles of Footwear" (now U.S. Pat. No. 9,265,305). Each of these parent applications is entirely incorporated herein by reference.

FIELD OF THE INVENTION

The present invention relates to the field of footwear. More specifically, aspects of the present invention pertain to articles of footwear that include foot insertion openings capable of widely opening the side and/or rear area(s) of the shoe to allow for easy insertion and removal of a foot. Footwear uppers with large openings of this type can be particularly useful for hightop athletic footwear, boots, or other footwear structures that extend up to or at least partially over a wearer's ankles.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation. The general features and configurations of uppers and sole structures are discussed in greater detail below.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to selectively change the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

Some articles of footwear, particularly footwear with uppers extending up to ankle height or over the ankle (also called "hightop" footwear herein, e.g., "hightop" basketball sneakers or other athletic footwear, workshoes, boots, and the like), can be difficult to put on and remove. If the shoes have laces or the like across the instep area, the wearer may be required to substantially loosen the laces (or other securing mechanisms) to enable the shoe to be easily put on and/or removed. These features can substantially increase the time and frustration level involved in putting on and taking off this "hightop" style of shoes.

Accordingly, there is room in the art for improvements in systems for enabling easy entry, removal, and/or securing of "hightop" footwear to the foot of wearers.

SUMMARY OF THE INVENTION

This Summary is provided to introduce some general concepts relating to this invention in a simplified form that are further described below in the Detailed Description. This Summary is not intended to identify key features or essential features of the invention.

Footwear structures in accordance with at least some aspects of this invention may include foot insertion openings that widely open the side and/or rear area(s) of the shoe (e.g., the upper) to allow for easy insertion and removal of a foot.

Some more specific aspects of this invention relate to articles of footwear that may include: (a) an upper having or defining an opening through which a leg of a wearer extends, wherein the upper further includes a foot insertion opening extending rearwardly and downwardly from a front portion of the leg opening at least to a heel area of the upper; (b) a closure system for releasably closing the foot insertion opening; and (c) a sole structure engaged with the upper. The closure system further may include one or more of: (a) a strap extending at least partially around the leg (e.g., across the front) and releasably securing to the upper, (b) a lace (optionally engaged with the strap via an elastic component) extending across the instep area one or more times, and/or (c) one or more elastic elements extending across the instep area of the upper. The closure system may include structures for tightening the fit of the shoe around and securing the shoe to the wearer's foot.

Additional or alternative aspects of this invention relate to articles of footwear that include: (a) an upper having a top opening, a first side, a second side, a first side edge extending downward from the top opening at the first side, and a second side edge extending downward from the top opening at the second side, wherein the upper further includes a foot insertion opening extending from the top opening or the first side edge and terminating at a closed end located at a side heel area of the upper on the second side of the upper; (b) a closure system engaged with the upper for releasably closing the foot insertion opening, wherein the closure system extends between the closed end and the top opening or first side edge of the upper; and (c) a sole structure engaged with the upper.

Still additional or alternative aspects of this invention relate to articles of footwear that include: (a) a sole structure; (b) an upper engaged with the sole structure, wherein the upper, at least in part, defines a foot-receiving volume configured to receive a wearer's foot in use, the upper including: (i) an ankle containing portion having a first side, a rear heel area, and a second side (e.g., as a continuous structure), (ii) a base portion including a first side and a second side, and (iii) a connecting member connecting the second side of the ankle containing portion and the second side of the base portion. In such footwear structures, with the sole structure supported on a horizontal support surface, the upper may be changeable by movement of the ankle containing portion with respect to the base portion at the connecting member between: (a) a foot engaging configuration (e.g., in which the first side of the ankle containing portion of the upper is positioned over at least a rear portion of the first side of the base portion to thereby close the upper) and (b) a foot insertion configuration (e.g., in which the first side of the ankle containing portion of the upper is positioned laterally/sideways outside of the second side of the base portion with respect to the foot-receiving volume of the upper to thereby open a rear heel area of the upper). A closure system also may be provided with the footwear structure, e.g., for releasably holding the upper in the foot engaging configuration.

While the invention is described above in terms of an entire article of footwear, additional aspects of this invention relate to uppers for use in such articles of footwear, methods of making such uppers and/or articles of footwear, and/or methods of securing such articles of footwear and/or uppers to a wearer's foot.

BRIEF DESCRIPTION OF THE DRAWINGS

The foregoing Summary of the Invention, as well as the following Detailed Description of the Invention, will be better understood when considered in conjunction with the accompanying drawings in which like reference numerals refer to the same or similar elements in all of the various views in which that reference number appears.

DETAILED DESCRIPTION OF THE INVENTION

Figure 1A:
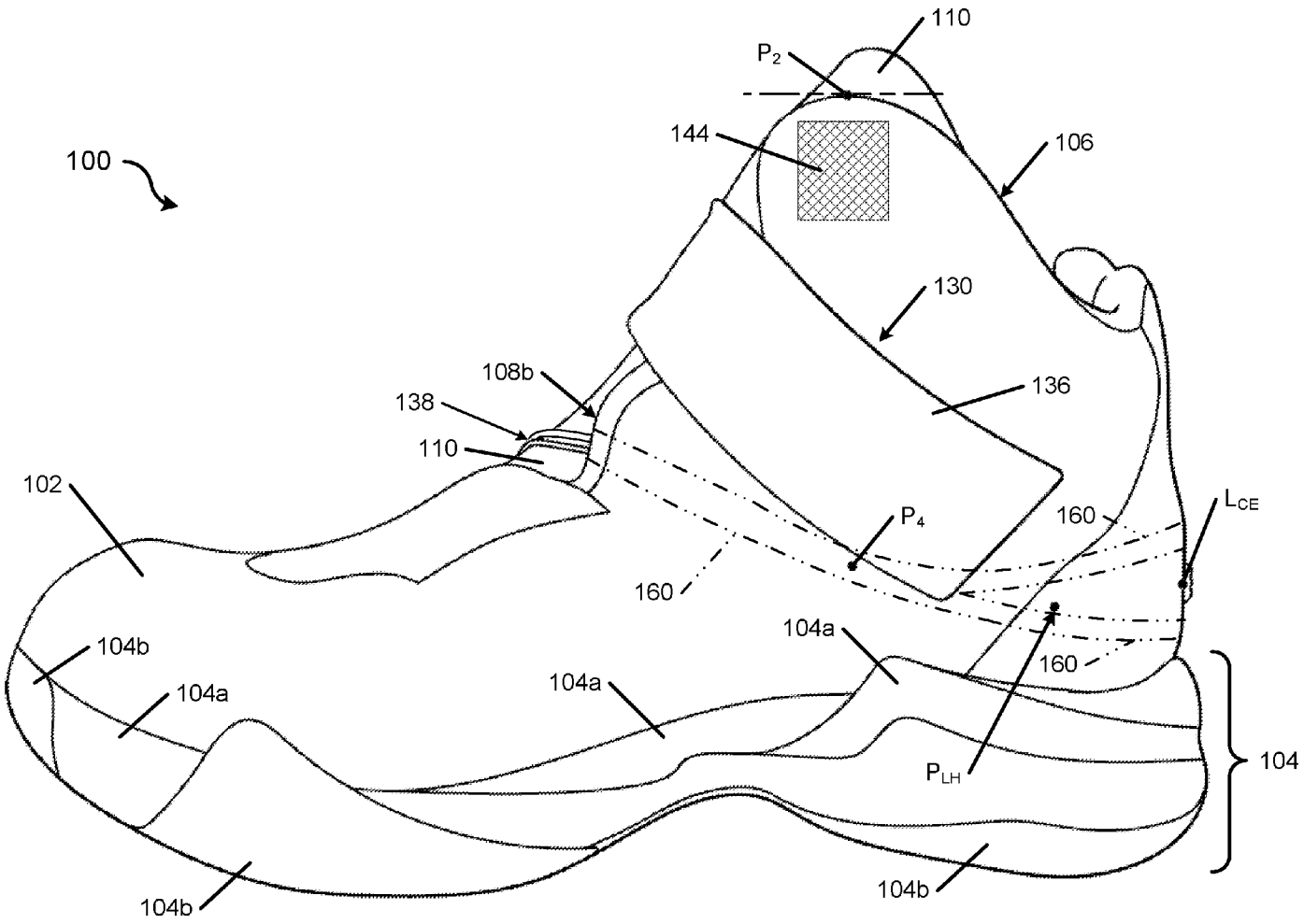
FIGS. 1A through 1E illustrate various views of an article of footwear according to some examples and aspects of this invention.

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made to the specifically described structures and methods without departing from the scope of the present invention.

I. GENERAL DESCRIPTION OF ASPECTS OF THIS INVENTION

Aspects of this invention relate to articles of footwear (e.g., athletic footwear) that include foot insertion openings that can widely open the side and/or rear area(s) of the shoe to allow for easy insertion and removal of a foot. Such footwear constructions can be particularly useful for "high-top" athletic footwear, boots, or other footwear having uppers that extend up to and/or at least partially over a wearer's ankles. More specific features and aspects of this invention will be described in more detail below.

Some aspects of this invention relate to articles of footwear that may include: (a) an upper having an opening through which a leg of a wearer extends (e.g., including a top opening, a first side edge extending forward from the top opening and along an instep area, and a second side edge opposite the first side edge and extending forward from the top opening and along the instep area), wherein the upper further includes a foot insertion opening extending rearwardly and downwardly from a front portion of the leg opening (e.g., from the first side edge) at least to a heel area of the upper; (b) a closure system for releasably closing the foot insertion opening (e.g., optionally including a zipper element or other releasable closure system); and (c) a sole structure engaged with the upper. The closure system further may include one or more of: (a) a strap extending at least partially around the leg (e.g., across the front of the leg, over the first side edge and over and beyond the second side edge, etc.) and releasably securing to the upper and/or sole structure, (b) a lace element (or an unstretchable tightening element) extending across the instep area one or more times and connecting the first and second side edges of the upper, and/or (c) one or more elastic or stretchable elements extending across the instep area and connecting the first and second side edges of the upper. This closure system may include structures for tightening the fit of the shoe around and securing the shoe to the wearer's foot.

Optionally, if desired, the strap (which optionally may be engaged with a slider element of the zipper system when the closure system includes a zipper system) may be engaged with the lace element such that pulling the strap pulls on and tightens the lace element at the instep area. In such structures, pulling on the strap to secure the shoe to a wearer's foot may function to close the closure system (e.g., zip the zipper system) and then tighten the lace element across the instep area. Optionally, in such structures, the lace element will be substantially inelastic and unstretchable, and this lace element may be engaged with the strap via one or more elastic elements (e.g., elastic band(s) that enable the strap to be pulled to a desired level of tightness). The strap, elastic element(s), and lace element may form a continuous path around the wearer's foot (e.g., from the top instep area and around the lower leg or ankle).

In other structures, however, the strap and the lace element and/or elastic elements across the instep area may be separated from one another such that while pulling on the strap to secure the shoe to a wearer's foot may function to close the closure system (e.g., zip the zipper system and/or tighten the strap around the foot), this action does not tighten or otherwise directly affect the lace element or other closure elements across the instep area. If desired, at least some portion(s) of the strap may be elastic or stretchable to enable some tightening around the leg.

Also, if desired, in some structures in accordance with this invention, at least some portions of the closure system (e.g., at least some portions of the lace element, at least some portions of elastic component(s) of the closure system, at least some portion of the strap, etc.) may extend between different layers of the upper. Some portions of the closure system (and its tightening system structures) may be located inside the upper and/or outside the upper as well. If desired, a guide system may be provided with the upper to form and maintain a path through which at least some portions of the closure system may pass. The guide system, which may constitute one or more individual parts or components, may form a tunnel or other passageway for containing portions of the closure system. The guide system features also can help reduce or eliminate undesired interactions between the closure/securing system elements and other items.

As another potential feature, articles of footwear in accordance with at least some examples of this invention may include a grip element engaged with the upper at a location proximate to the leg opening of the shoe (e.g., at or near the top opening through which the wearer's leg extends when the shoe is secured to the foot, at or near an edge of the leg opening, at or near the foot insertion opening and/or at or near the closure system for the foot insertion opening). This grip element may be held by the wearer as the wearer pulls the top portion of the upper (above the foot insertion opening and the closure system) to open the closure system for removal of the foot. The grip element may include tactile or grip enhancing features and/or it may provide added durability or wear resistance for this area (in view of its repeated handling for removing the shoe).

While the foot insertion opening in the shoe may extend any desired distance around the upper, in at least some examples of this invention, the foot insertion opening extends at least to a rear heel area of the upper, and in some instances to or beyond a vertical line extending upward from a rearmost point of the upper.

Still other example features and aspects of this invention relate to articles of footwear that include: (a) an upper having a top opening, a first side, a second side, a first side edge extending downward from the top opening at the first side, and a second side edge extending downward from the top opening at the second side. This example upper further includes a foot insertion opening extending from the top opening or the first side edge and terminating at a closed end located at a side heel area of the upper on the second side of the upper; (b) a closure system engaged with the upper for releasably closing the foot insertion opening, wherein the closure system extends between the closed end and the top opening or the first side edge of the upper. A sole structure is engaged with the upper.

The second side edge of at least some example uppers according to this aspect of the invention may include a downward extending segment (extending downward from the top opening) and a rearward extending segment, and this rearward extending segment of the second side edge may terminate at a closed end (located at the second side of the upper). In at least some examples of this invention, the closed end of this second side edge may be located a shortest direct line distance L from the closed end of the foot insertion opening and/or the closed end of the closure system (described above), wherein L is within a range from 5 mm to 80 mm, and in some examples from 10 mm to 70 mm, from 12 mm to 55 mm, or even from 15 mm to 45 mm. Both the closed end of the rearward extending segment of the second side edge and the closed end of the foot insertion opening and/or closure system may be located on a same side of the upper/article of footwear (e.g., a lateral side or outside of the upper/footwear).

Optionally, a connecting member may be provided, e.g., extending between the closed end of the foot insertion opening and the closed end of the rearward extending segment of the second side edge. In such structures, an ankle containing portion of the upper may be movable with respect to a base portion of the upper about this connecting member to change the upper from a foot insertion configuration to a foot engaging configuration. The connecting member may include, for example, a continuous strip or section of upper material that extends, e.g., from the closed end of the foot insertion opening to the closed end of the rearward extending segment of the second side edge; a strip or section of another material (e.g., a fabric, a textile, leather, polymeric material, etc.) attached to the upper (e.g., to the ankle containing portion and the base portion described above) that extends, e.g., from the closed end of the foot insertion opening to the closed end of the rearward extending segment of the second side edge; a mechanical hinge member; a plastic or polymeric member having a pre-formed "bend line;" etc.

In at least some examples of these aspects of the invention, the closure system may include a track (e.g., a zipper track) having at least a portion or segment extending along the second side of the upper. A closure element (e.g., a zipper slider) movable along the track may be used, for example, to change the foot insertion opening between an open condition and a closed condition and to change the upper between a foot engaging configuration and a foot insertion configuration. If desired, in at least some examples of this invention, an end portion of the track portion or segment along the second side of the upper may substantially align with an extension direction of the rearward extending segment of the second side edge of the upper.

As further or alternative potential features, if desired, an ankle strap may be secured to the closure element (e.g., a zipper slider) and the second side of the upper may have a securing member (e.g., a portion of a buckle assembly, a portion of a hook-and-loop fastener, a button/buttonhole, a portion of a snap fastener, etc.). In such structures, if desired, in the "closed condition," the closure element may be stopped along the track at the top opening or the first side edge of the upper, but the ankle strap may extend around a front instep or front ankle portion of the upper (e.g., across a front of a tongue portion of the upper) and may be secured to the securing member at the second side of the upper. As further potential features, if desired, when the sole structure is supported on a horizontal support surface, this ankle strap may extend to (and be secured at) a location on the second side of the upper that is more rearward than a location of the closed end of the foot insertion opening and/or more rearward than the connecting member (e.g., the ankle strap may extend to a location that vertically overlaps the foot insertion opening on the second side of the upper). In this manner, a tight and secure fit can be provided 360° around the wearer's ankle.

Additionally or alternatively, if desired, a forefoot/midfoot securing strap may be provided in at least some examples of this invention, e.g., a strap that crosses a top forefoot and/or midfoot portion of the upper/article of footwear one or more times. As some more specific examples, uppers/articles of footwear according to at least some examples of this aspect of the invention may include: (a) a first strap engaging component (e.g., a first tensioning ring or other tensioning device) provided at a midfoot portion on the second side of the upper; (b) a second strap engaging component (e.g., another tensioning ring or other tensioning device, a portion of a buckle, a button or buttonhole, a portion of a snap fastener, a portion of a hook-and-loop fastener, etc.) provided at a midfoot portion on the first side of the upper; and (c) a securing strap extending across a top forefoot and/or top midfoot portion of the upper (e.g., at least two times). As some more specific examples, the securing strap may include (a) a first portion fixed at a forefoot portion on the first side of the upper (e.g., by a sewn seam, by engagement between the upper and the sole structure, by adhesives or cements, by mechanical connectors, etc.) and (b) a flexible strap portion extending from the first portion, to the first strap engaging component (e.g., to tensioning device, through the tensioning ring, etc.), and to the second strap engaging component (e.g., to engage a securing mechanism such as a button, snap, hook-and-loop fastener, etc.; to extend through a tensioning device, such as a tensioning ring; etc.). As another potential option or feature, the securing strap may be secured to the upper and/or to itself in a tensioned condition (e.g., by a hook-and-loop fastener arrangement, etc.).

The closure system "track" in some examples and aspects of this invention may include a first side portion, a rear heel portion, and a second side portion, wherein (with the sole structure supported on a horizontal support surface) a vertically lowest section of the track may be located in the rear heel portion of the track. In this arrangement, the track may extend to the first side portion (on one side of the upper) and to the second side portion (on the other side of the upper) in upward directions forward from this vertically lowest section. In this manner, when viewed from a top and/or rear point of view, the closure system track may have somewhat of an upwardly inclined U-shape around the rear heel area.

Articles of footwear in accordance with some examples and/or aspects of this invention may include: (a) a sole structure; (b) an upper engaged with the sole structure, wherein the upper, at least in part, defines a foot-receiving volume configured to receive a wearer's foot in use, the upper including: (i) an ankle containing portion having a first side, a rear heel area, and a second side (e.g., as a continuous structure), (ii) a base portion including a first side and a second side, and (iii) a connecting member connecting the second side of the ankle containing portion and the second side of the base portion. In at least some such structures, with the sole structure supported on a horizontal support surface, the upper may be changeable (by movement of the ankle containing portion with respect to the base portion at the connecting member) between: (a) a foot engaging configuration (e.g., in which the first side of the ankle containing portion of the upper is positioned over at least a rear heel portion of the first side of the base portion to close the upper) and (b) a foot insertion configuration (e.g., in which the first side of the ankle containing portion of the upper is positioned laterally/sideways outside of the second side of the base portion with respect to the foot-receiving volume of the upper to open a rear heel area of the upper). Such articles of footwear additionally may include a closure system, e.g., for releasably holding the upper in the foot engaging configuration. This closure system may engage at least a section of a lower edge of the ankle containing portion with at least a section of an upper edge of the base portion. As some more specific examples, this closure system may include: (a) a first track portion (e.g., a zipper track portion) extending along the section of the lower edge of the ankle containing portion, (b) a second track portion (e.g., a zipper track portion) extending along the section of the upper edge of the base portion, and (c) a closure element (e.g., a zipper slider) movable along the section of the first track portion and the section of the second track portion, wherein movement of the closure element along the track changes the upper between the foot engaging configuration and the foot insertion configuration. The track may extend along: (a) at least a majority of a length of the foot insertion opening, (b) at least a majority of a length of the lower edge of the ankle containing portion, and/or (c) at least a majority of a length of the upper edge of the base portion (and in some examples, the track may extend along at least 70%, at least 90%, at least 95%, and/or even 100% of these foot insertion opening, upper edge, and/or lower edge lengths).

If desired, the ankle containing portion of these example uppers may include: (a) a top edge; (b) a first edge extending from the top edge, along the first side of the ankle containing portion, around the rear heel area of the ankle containing portion, to the second side of the ankle containing portion, and to a first side of the connecting member; and (c) a second edge extending from the top edge, along the second side of the ankle containing portion, and to a second side of the connecting member. At least a portion of this first edge may include the closure system track portion described above (and form at least a portion of the "lower edge" of the ankle containing portion). The second edge of the ankle containing portion may include a downward extending segment and a rearward extending segment that extends to the second side of the connecting member. If desired, a length dimension from the first side of the connecting member to the second side of the connecting member may be within a range from 5 mm to 80 mm, and in some examples from 10 mm to 70 mm, from 12 mm to 55 mm, or even from 15 mm to 45 mm.

Articles of footwear including ankle containing portions and upper base portions in accordance with these aspects of the invention further may have: (a) any one or more of the ankle strap features/structures described above, (b) any one or more of the forefoot securing strap features/structures described above, and/or (c) any one or more of the closure system and/or track features/structures described above.

Given the general description of features, aspects, structures, processes, and arrangements according to certain embodiments of the invention provided above, a more detailed description of specific example articles of footwear and methods in accordance with this invention follows.

II. DETAILED DESCRIPTION OF EXAMPLE ARTICLES OF FOOTWEAR ACCORDING TO THIS INVENTION

Referring to the figures and following discussion, various articles of footwear and features thereof in accordance with the present invention are described. The footwear depicted and discussed are athletic shoes, and the concepts disclosed with respect to various aspects of this footwear may be applied to a wide range of athletic footwear styles, including, but not limited to: basketball shoes, football shoes, hiking shoes, casual wear shoes, and the like. In addition, at least some concepts and aspects of the present invention may be applied to a wide range of non-athletic footwear, including work boots, dress boots, and the like. Accordingly, the present invention is not limited to the precise embodiments disclosed herein, but applies to footwear generally.

Figure 1B:
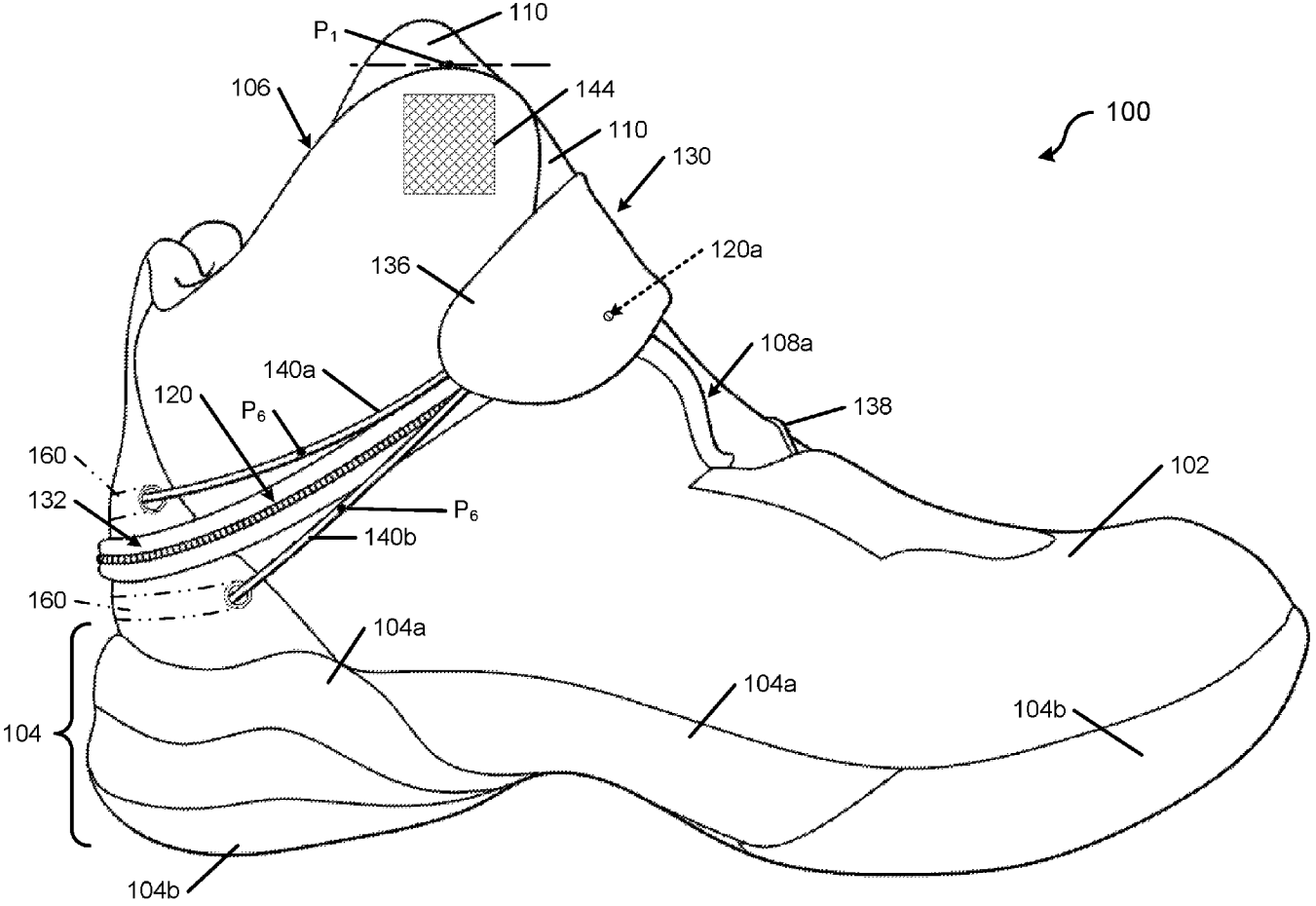
Figure 1C:
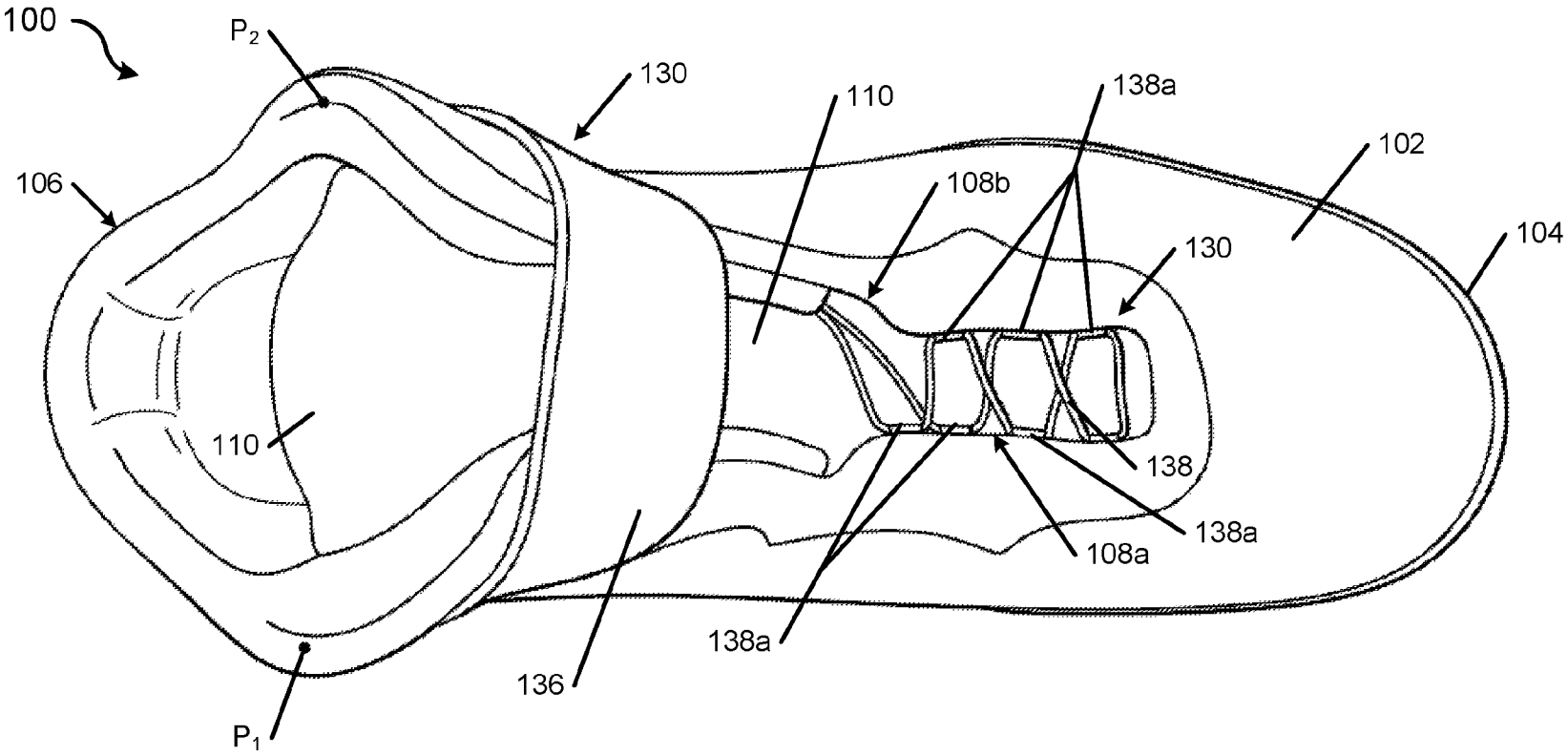
Figure 1D:
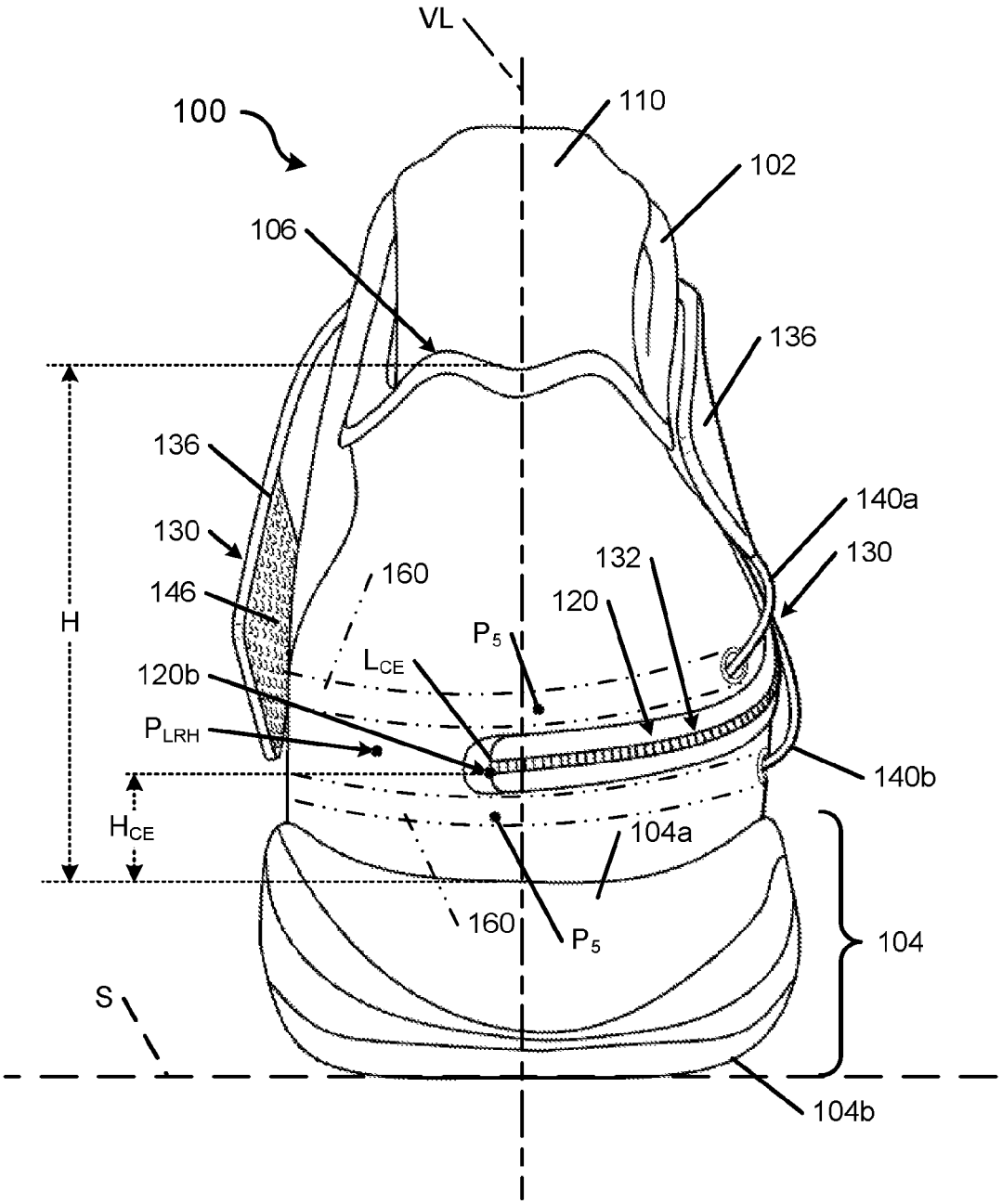
Figure 1E:
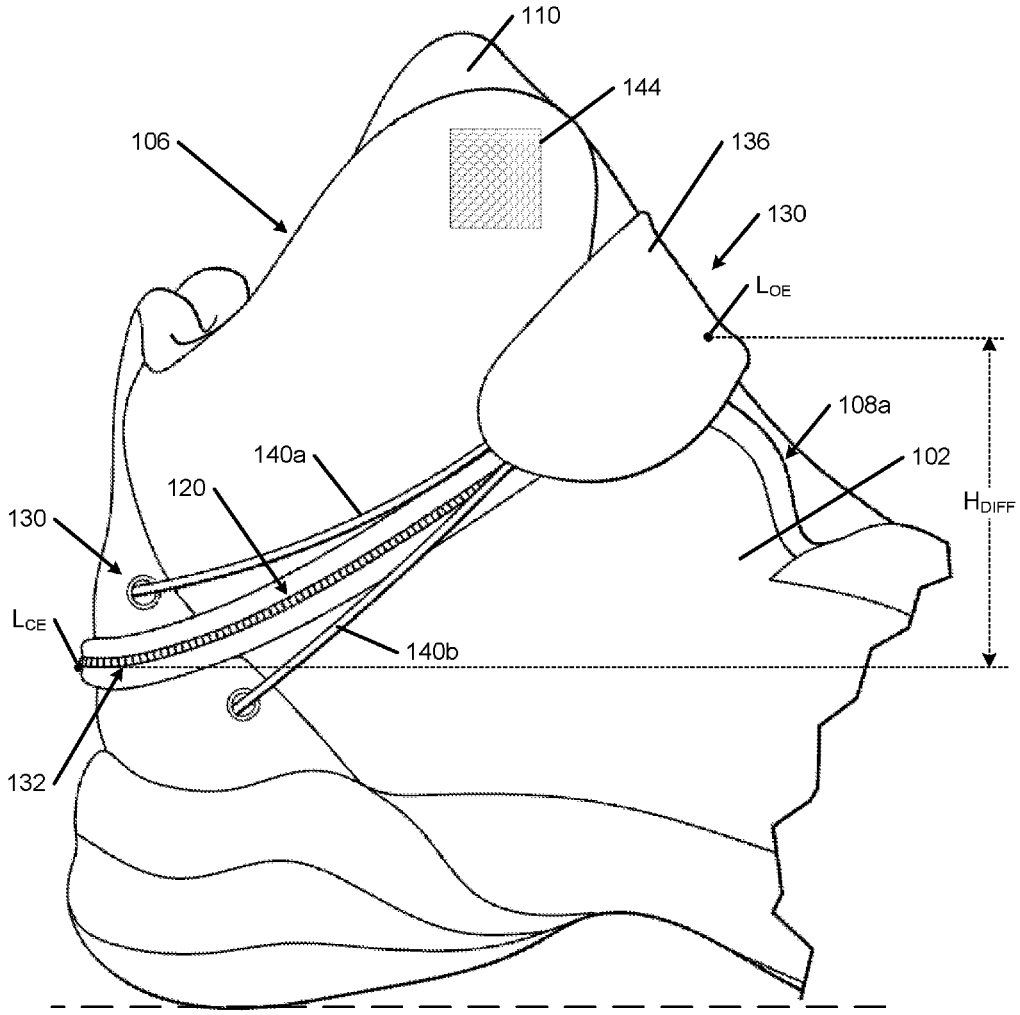

FIGS. 1A through 1E provide various views of one example article of footwear 100 in accordance with aspects of this invention. FIG. 1A is a lateral side view, FIG. 1B is a medial side view, FIG. 1C is a top view, FIG. 1D is a rear view, and FIG. 1E is a close up view of a portion of the closure or securing system for this example article of footwear 100. As generally shown in these figures, the article of footwear 100 includes an upper 102 and a sole structure 104 engaged with the upper 102. The upper 102 of this illustrated example is a hightop athletic shoe upper (e.g., for basketball), although other shoe styles and upper styles are possible. The upper 102 of this example may include a strobel member or other structure extending along the bottom, plantar support surface (to at least partially enclose the bottom of the foot-receiving chamber). The top of the upper 102 defines a leg opening 106 for the shoe (through which the wearer's leg extends when the shoe 100 is secured to the foot).

While it may take on any desired configuration and/or structure without departing from the invention, the sole structure 104 of this illustrated example shoe 100 includes a polymer foam midsole 104*a* (e.g., made from polyurethane foam, an ethylvinylacetate (EVA) foam, a lightweight foam from the LUNAR family of products (available from NIKE, Inc., of Beaverton, Oreg., etc.)). Additionally or alternatively, if desired, the midsole 104*a* may include one or more impact force attenuating columns (e.g., made of foam), one or more mechanical impact force attenuating components (e.g., "shock absorber" type structures), and/or one or more fluid-filled bladder structures. This midsole 104*a* is engaged with one or more outsole components 104*b* that at least partially cover the midsole 104*a* (e.g., by being glued or otherwise fixed to it) and provide at least a portion of a ground contact surface (e.g., with wear resistance properties, one or more traction elements, etc.). The midsole 104*a* and/or outsole 104*b* may constitute one or more independent parts, and they may extend the entire length and/or width of the article of footwear 100 or only portions thereof. Also, while shown exterior to the upper 102 in this illustrated example, some or all of the midsole 104*a* could be contained (or at least partially contained) within the interior chamber defined by the upper 102. If desired, the strobel mentioned above could be omitted (or at least partially omitted) and the midsole 104*a* could provide the plantar support surface (or at least a portion thereof) for the article of footwear 100.

As further shown in these figures, the upper 102 of this illustrated example includes the top leg opening 106. The overall opening of this example article of footwear 100 includes a first side edge 108*a* (e.g., a medial side edge) extending forward from the top opening 106, downward to and along the instep area of the shoe 100. A second side edge 108*b* (e.g., a lateral side edge, opposite the first side edge 108*a*) also extends forward from the top opening 106, downward to and along the instep area of the shoe 100. The upper 102 further may include a tongue element 110 or other moderator component (e.g., a bootie type member) that lies along the front of the lower leg and ankle area and over the instep area of the shoe 100 (beneath side edges 108*a*, 108*b* and between the side edges 108*a*, 108*b* and a wearer's foot).

As further shown in FIGS. 1B and 1D through 2C, this example upper 102 further includes a relatively large foot insertion opening 120 that extends rearwardly and downwardly from the first side edge 108*a* at least to a heel area of the upper 102. A closure/securing system 130 (including a zipper system 132) is provided for releasably closing the foot insertion opening 120 and securing the shoe 100 to a wearer's foot. These features of this example footwear structure 100 will be described in more detail below.

Figure 2A:
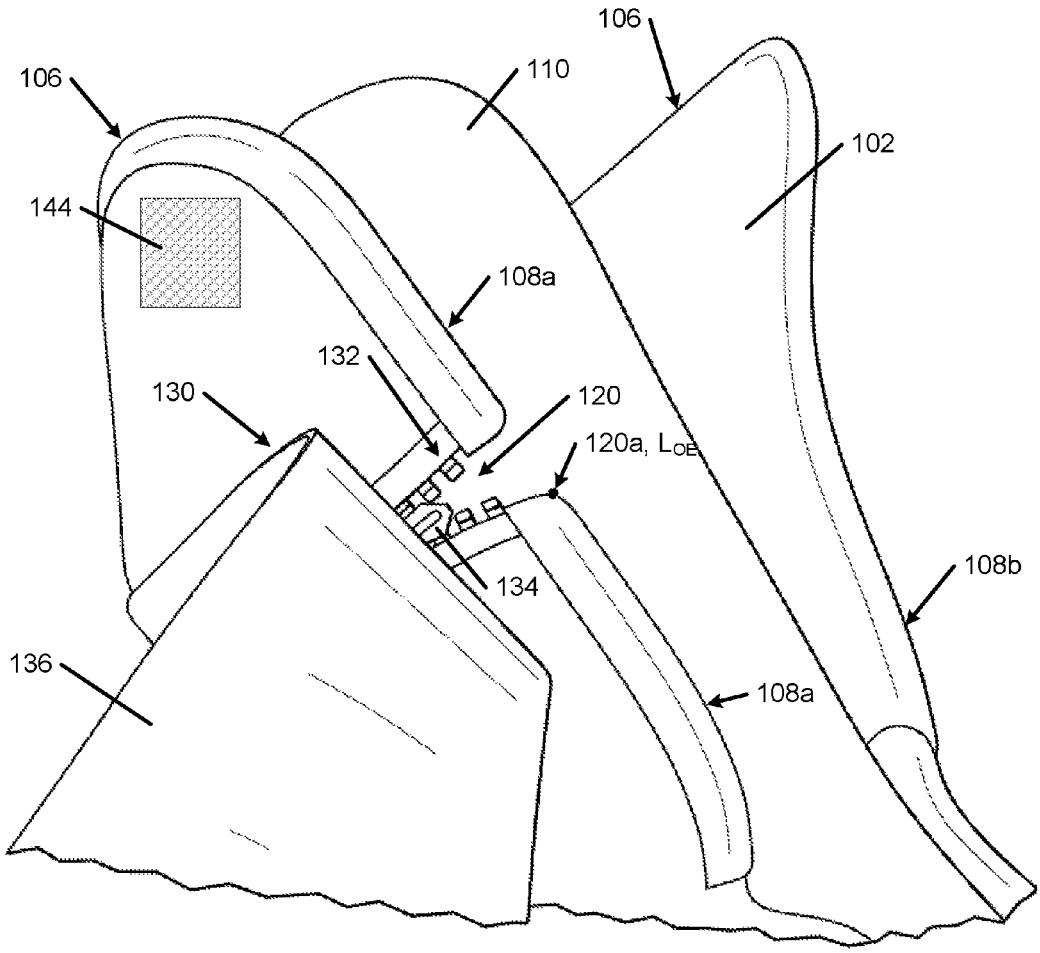
FIGS. 2A through 2C include views illustrating steps involved in disengaging the article of footwear of FIGS. 1A through 1E from a wearer's foot in accordance with at least some aspects of this invention.
Figure 2B:
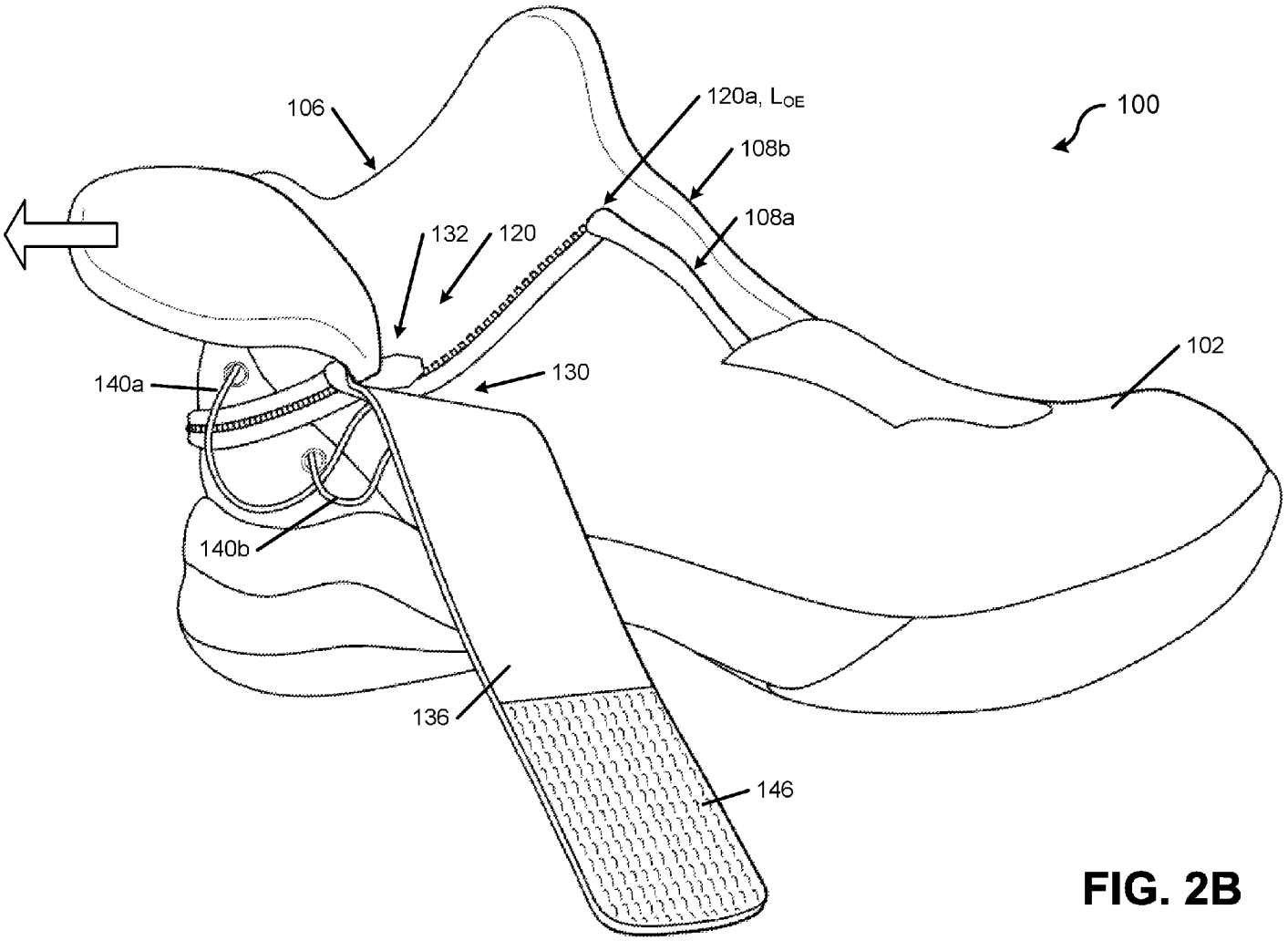

The foot insertion opening 120 allows the top opening 106 and upper 102 of the shoe 100 to be opened wider to allow for easy insertion of a foot. As shown in FIGS. 1B and 2A, the forward end 120*a* of the foot insertion opening 120 begins at the first side edge 108*a* in an ankle/lower leg covering area of the upper 102. This forward end 120*a* may start at other locations along the overall shoe opening, including from the top opening portion 106 (optionally along a side of a wearer's leg) or at other locations along the first edge 108*a* (e.g., nearer to the top opening 106, further down toward and even to the instep area, etc.). Additionally or alternatively, the foot insertion opening 120 could begin at (and be located at) the second side edge 108*b*, if desired.

As noted above, the foot insertion opening 120 in this illustrated example extends downwardly and rearwardly from the first side edge 108*a*. The opening 120 may extend at least to a rear heel area of the upper 102 (e.g., so the closed end 120*b* of the opening 120 is located in the rear heel area). As some more specific examples, the foot insertion opening 120 may extend at least to a vertical line VL extending through a rearmost point of the upper 102, or even beyond this vertical line VL (see the location of closed end 120*b* in FIG. 1D). The closed end 120*d* of the opening 120 may extend to the opposite side of the upper 102 even further than the distance shown in FIG. 1D to further open the upper 102 for receiving a foot, even to the lateral rear heel area (e.g., point $P_{LRH}$ in FIG. 1D) or the lateral side heel area (point $P_{LH}$ in FIG. 1A), if desired.

While the actual size of the foot insertion opening 120 may vary (e.g., depending on the shoe size, etc.), in at least some examples of this invention, the foot receiving opening 120 will extend for a length (from Points $L_{OE}$ to $L_{CE}$ along the zipper system 132) around at least 35% of a perimeter dimension of the top opening 106 around the heel (i.e., the dimension of the top leg opening 106 around the heel from the first side edge 108*a* ($P_1$) to the second side edge 108*b* ($P_2$)). Points $P_1$ and $P_2$ are located where the top leg opening 106 meets the side edges 108*a* and 108*b*, respectively. If a clear corner point transitioning between the top opening 106 and the side edges 108*a* and/or 108*b* is not provided in a specific footwear model at those locations, the points $P_1$ and $P_2$ may be determined as the location of a horizontal tangent point where the top opening 106 and the side edges 108*a*, 108*b* meet (when the shoe 100 sits on a horizontal surface). In some more specific examples, the foot insertion opening 120 (e.g., the longitudinal length of the zipper track) will extend around at least 40%, at least 50%, or even at least 55% of this perimeter dimension. From a more absolute dimensional point of view, in at least some examples of this invention, the length of the foot insertion opening 120 (from Points $L_{OE}$ to $L_{CE}$ along the zipper track) may be at least 5 inches, and in some examples, at least 6 inches, or even at least 7 inches.

From a vertical point of view, the closed end 120*b* of the foot insertion opening 120 may be located at less than 35% of an overall height dimension of the upper 102 at the location of the closed end 120*b*. More specifically, as shown in FIG. 1D, the vertical dimension (with the shoe 100 sitting on a horizontal support surface S) from the closed end 120*b* to the location where the upper 102 and sole 104 meet (at the upper surface of midsole 104*a*, in this example), $H_{CE}$, is 35% or less than an overall vertical height H of the upper 102 at that location. In some more specific examples, the closed end 102*b* of the foot insertion opening 120 may be located at a height 30% or less, 25% or less, or even 20% or less of this overall height dimension H.

From a more absolute dimensional point of view, in at least some examples of this invention, the closed end 120*b* (point $L_{CE}$) may be located less than 1.25 inches vertically from the upper/sole junction point at that location, and in some examples, less than 1 inch, or even less than 0.75 inches from that junction point. With respect to actual height from a horizontal contact surface S, the closed end 120*b* (point $L_{CE}$) may be located less than 2.5 inches vertically from the contact surface S, and in some examples, less than 2.25 inches, less than 2 inches, or even less than 1.75 inches from that contact surface S. Additionally, with respect to actual height from a horizontal contact surface S, the open end 120*a* (point $L_{OE}$) may be located at least 3.5 inches vertically from the contact surface S, and in some examples, at least 3.75 inches, at least 4 inches, or at least 4.25 inches from the contact surface S. The vertical spacing distance between the closed end 120*b* (point $L_{CE}$) and the open end 120*a* (point $L_{OE}$) ($H_{DIFF}$ in FIG. 1E) may vary without departing from this invention. In some more specific examples, the vertical height differential between points $L_{CE}$ and $L_{OE}$ ($H_{DIFF}$) may be at least 1.5 inches, and in some examples, at least 1.75 inches, at least 2 inches, and even at least 2.25 inches.

Various aspects and example features of footwear closure/securing systems (e.g., system 130) for articles of footwear according to at least some examples of this invention now will be described in more detail. As shown in FIGS. 1A through 3A, this example article of footwear 100 includes a zipper system 132 engaged with the upper 102 on opposite side edges of the foot insertion opening 120 for at least partially closing the foot insertion opening 120. In this example construction, the zipper system 132 fully closes the foot insertion opening 120 (i.e., extends from Points $L_{OE}$ to $L_{CE}$). Thus, zipper system 132 may have a length of at least 35% of the perimeter dimension of the top opening 106 around the heel discussed above (and in some examples, this length will be at least 40%, at least 50%, or even at least 55% of this perimeter dimension). From a more absolute dimensional point of view, in at least some examples of this invention, the length of the zipper system 132 (from Points $L_{OE}$ to $L_{CE}$ along the zipper track) may be at least 5 inches, and in some examples, at least 6 inches, or even at least 7 inches. Releasable closure systems other than zippers could be used, if desired, in some constructions according to some aspects of this invention.

The slider element 134 of the zipper system 132 in this illustrated example is engaged with (or integrally formed to include) a strap 136. The strap 136 in this illustrated example extends from the medial side of the upper 102, over the first side edge 108*a*, beyond the second side edge 108*b*, and releasably secures to the lateral side of the upper 102 (e.g., via a hook-and-loop type fastener system 146, via a buckle type assembly, via other mechanical connectors, etc.). The strap 136 and its securing features help keep the zipper system 132 closed (e.g., keeping slider element 134 at or near point $L_{OE}$) and help secure the shoe 100 to the wearer's foot in a snug and comfortable manner.

The closure/securing system 130 of this example footwear structure 100 further includes a lace element 138 extending across the instep area of the shoe 100 and connecting the first side edge 108*a* and the second side edge 108*b* of the upper 102. If desired, this lace element 138 may engage the upper 102 through eyelets or eyelet type openings formed in the upper 102 (e.g., near side edges 108*a*, 108*b*) in a conventional manner as is commonly known and used in the footwear art. Additionally or alternatively, the lace element 138 also may be tied at the front/top of the upper 102 (e.g., at the instep and/or front leg area) in manners that are known and used in the footwear art. The lace element 138, at least in part, may constitute a non-stretchable cord, textile, plastic, fiber, metal, or other component. The terms "non-stretchable" or "unstretchable" as used herein in this context mean a material that stretches less than 10% of its length (i.e., less than 0.2 inches for a 2 inch length of the material), when a tensile force of 10 lbs is applied to a 2 inch length of the material.

In this illustrated structure 100, the lace element 138 engages with strap members 138*a* that may extend at least partially around the wearer's foot and/or at least partially beneath a plantar support surface of the shoe. If desired, at least some of strap members 138*a* may extend completely around the plantar support surface of the shoe 100, from edge 108*a* to edge 108*b*. Lace engagement structures and strap members 138*a* of this type are described in U.S. Patent Appln. Publ. Nos. 2012/0011744 and 2012/0198720, which applications are entirely incorporated herein by reference. Any of the wrap-around foot engaging systems and/or lace engaging structures described in these patent publications may be used in connection with the footwear structure 100 according to this invention. These types of wrap-around foot engaging systems and/or lace engaging structures can help provide a very comfortable, adaptive, and secure fit of an article of footwear to a wearer's foot.

The closure/securing system 130 of this example footwear structure 100 includes additional features. As illustrated in FIGS. 1B and 1E, the strap 136 is engaged with two stretchable or elastic members 140*a* and 140*b* (although one or more elastic members may be used without departing from this invention). The elastic members 140*a* and 140*b* help assure that the strap 136 is pulled tightly to engage the strap 136 around the wearer's foot, e.g., as shown in FIG. 1E. While not a requirement, as shown in the illustrated example, portions of elastic members 140*a* and 140*b* extend between layers of the upper (e.g., as shown FIG. 1B). The elastic members 140*a* and/or 140*b* may extend through guide system 160 (also called a "guide element" or "guide member" herein), as will be explained in more detail below in conjunction with FIGS. 4A through 4D (and potential guide system 160 locations and tracks are shown in dash-double dot lines in FIGS. 1A, 1B, and 1D). The term "stretchable" as used herein in this context means a material that stretches at least 25% of its length (i.e., at least 0.5 inches for a 2 inch length of the material) when a tensile force of 10 lbs is applied to a 2 inch length of the material. An "elastic" material is a "stretchable" material the returns at least substantially (i.e., at least 95%) to its original length when the 10 lb force is released. Additionally or alternatively, if desired, at least a portion of the strap 136 may be stretchable (in place of or in addition to any stretch provided by the elastic members 140*a*, 140*b*).

If desired, the elastic member(s) (e.g., 140*a*, 140*b*) or other strap 136 tightening or securing structures may be fixedly engaged with the shoe 100 (e.g., with the upper 102, with the sole structure 104, between the upper 102 and sole structure 104, etc.) to provide a support for pulling the strap 136 and stretching the elastic member(s) 140*a*, 140*b* and/or strap 136. Such a system may be used, for example, if the lace element 138 is of a conventional design (e.g., separately tied by the wearer) or if the lace element 138 is replaced with another type of instep closure system, such as one or more elastic bands (as described in more detail below in conjunction with FIG. 5) or other elements. The example footwear structure 100 of FIGS. 1A through 1E, however, has a different construction. As shown in FIG. 1C, in this example structure 100, the two opposing ends of lace element 138 extend between layers of the upper 102 at a location along the second side edge 108*b* of the upper 102. Thus, in this example structure, the lace 138 engages more eyelet or other lace engaging elements 138*a* on the first side 108*a* than on the second side 108*b*, and the free ends of the lace element 138 come close together and extend along the upper 102 on the second side 108*b*. If desired, the lace element 138 may extend through a guide system 160, as will be explained in more detail below in conjunction with FIGS. 4A through 4D. These ends of lace element 138 may engage (directly or indirectly) with free ends of elastic members 140*a* and 140*b* (e.g., at a location inside or between layers of the upper 102) such that pulling the strap 136 to stretch the elastic members

140*a* and 140*b* applies a tensile force to pull and tighten the lace element 138 at and across the instep area.

Therefore, the closure/securing system 130 in accordance with this illustrated example footwear structure 100 includes: (a) a first portion (e.g., the lace element 138) that extends between the first side edge 108*a* and the second side edge 108*b* at the instep area (this lace element 138 may tighten a strap system that wraps around the sides and at least to a plantar support area of the shoe), (b) a second portion (e.g., at least a portion of lace element 138 and/or at least a portion of elastic members 140*a*, 140*b*) that extends past the second side edge 108*b* (and optionally inside or between layers of the upper 102) and around the heel area of the upper 102, and (c) a third portion (e.g., strap 136) that extends past the first side edge 108*a* and over the second side edge 108*b* to releasably engage the upper 102 (e.g., via a hook-and-loop type fastener arrangement). The first, second, and third portions of the closure/securing system 130 may form a continuous path (e.g., from the front, instep area of the shoe 100 to the free end of strap 136). At least some of the first and/or second portions of the closure/securing system 130 may be unstretchable, while at least some of at least one of the second and/or third portions of the closure/securing system 130 may be elastic or stretchable. If desired, at least some of the first and/or second portions of the closure/securing system 130 (e.g., at least some of lace element 138 and/or elastic members 140*a*, 140*b*) may extend inside the upper 102 and/or between layers of the upper 102. Additionally or alternatively, if desired, at least some of the third portion of the closure/securing system 130 (e.g., the strap 136) may extend inside the upper 102 and/or between layers of the upper 102.

Operation of the closure/securing system 130 will be described in more detail below in conjunction with FIGS. 2A through 3A. FIGS. 1A through 1E illustrate the article of footwear 100 with the closure/securing system 130 engaged and pulled tight, e.g., as it would be when secured to a wearer's foot (not shown). In this arrangement, the elastic members 140*a*, 140*b* (or other elastic portions) may be pulled tight and held in place by a releasable engagement between the strap 136 and the upper 102 (or sole structure 104), e.g., via a hook-and-loop fastener system 146, via a buckle assembly, via another type of releasable connection, etc.). This configuration also may pull the slider 134 of the zipper system 132 to the open end 120*a* of the foot insertion opening 120, thereby closing the foot insertion opening 120.

To remove the shoe 100 from the foot, first the strap 136 is released from its releasable connection to upper 102 and/or sole structure 104 (e.g., by disconnecting the components of the hook-and-loop fastener 146). This action causes the elastic members 140*a*, 140*b* to return back toward their unstretched condition. The elastic portions of the closure/securing system 130 (e.g., elements 140*a*, 140*b*, and/or elastic in the strap 136) may be sized so that when the tensile force is released in this manner, retraction of the elastic components will cause the slider element 134 of the zipper system 132 to begin moving down the track of the zipper 132 (at least if the slider element 134 had been extended to the end 120*a* of the zipper track). As an example, this release of tensile force may move the slider element 134 at least a few teeth down the zipper track (e.g., 1 to 10 teeth), as shown in FIG. 2A. This tensile force release also may, at least in part, loosen the lace element 138 across the instep area of the shoe 100 (e.g., if the strap 136 and elastic members 140*a*, 140*b* are operatively coupled with the lace element 138).

Figure 2C:
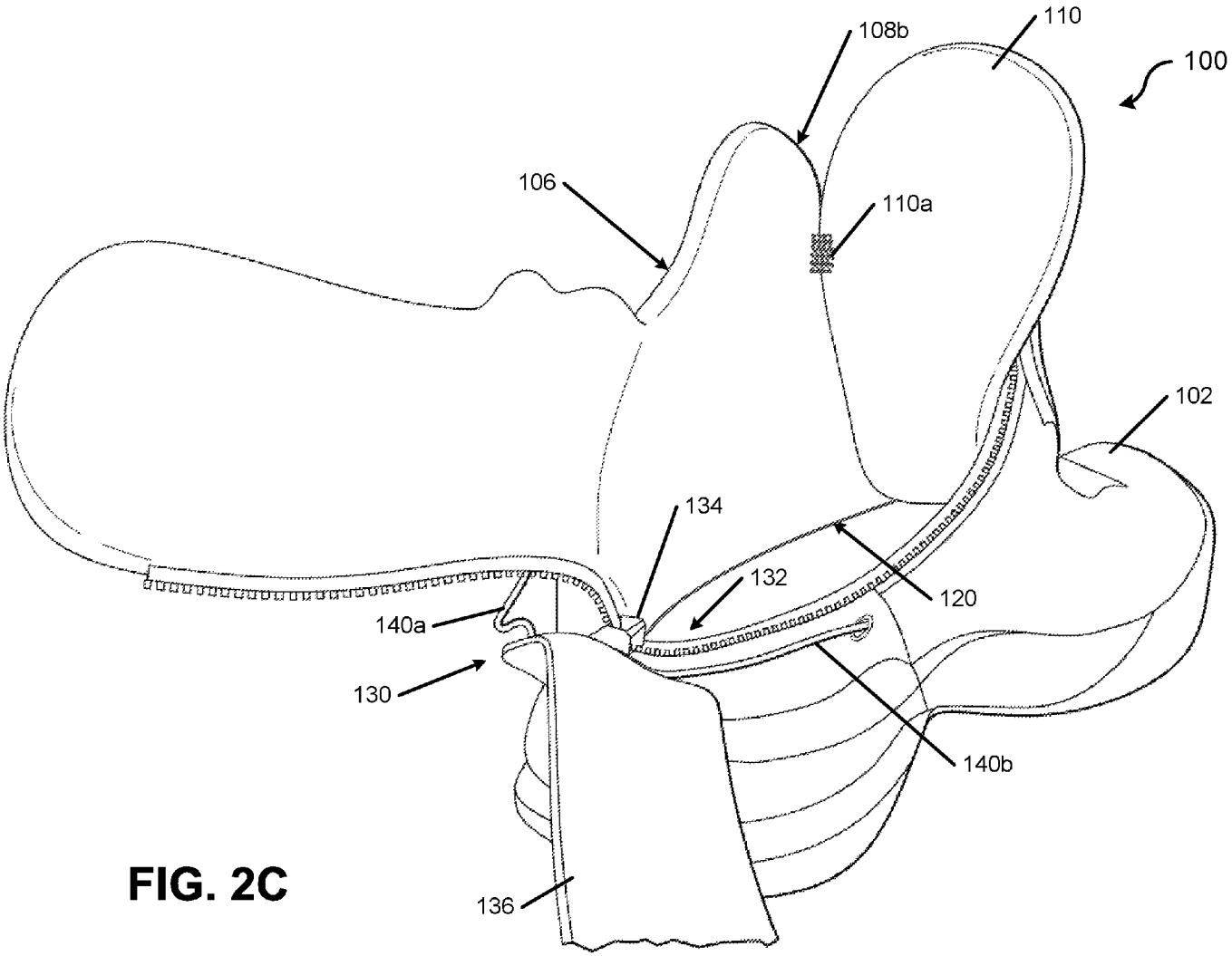

If desired, one could continue to open the zipper system 132 by pulling the strap 136 to move the slider 134 further down the zipper track (optionally to closed end 120*b*). Alternatively, the wearer can grasp the upper 102 at a location above and/or rearward of the foot insertion opening 120 and pull the top portion of the upper 102 rearward to move the slider element 134 down the zipper track (and to essentially unwrap the upper 102 from around the wearer's leg). See FIG. 2B. As shown in FIG. 2C, this action moves the slider element 134 rearward and downward toward and/or to the closed end 120*b* of the foot insertion opening 120 and opens up a large, wide area for removal and insertion of a foot. Optionally, if desired, the upper 102 may include a grip enhancing and/or wear/abrasion resistant element 144 at a location where the user will tend to grip the upper 102 during this closure/securing system 130 loosening phase. In addition or as an alternative to a layer of grip enhancing and/or wear/abrasion resistant material, element 144 also may include a projecting tab (e.g., of fabric or plastic) or a handle element extending outward from the upper (capable of being grasped).

To put the shoe 100 on, the shoe 100 can start with the closure/securing system 130 in the arrangement shown in FIG. 2C, and the user can insert his/her foot into the shoe 100 through the opened closure/securing system 130. If desired, the tongue element 110 may be secured to the upper 102, e.g., along one or both of the side edges 108*a*, 108*b*, to help prevent the tongue element 110 from falling into the interior of the shoe 100 (and thus being in the way when the user inserts his/her foot). This can be accomplished, for example, using sewing or stitching (to tack the tongue element 110 to one or both edges 108*a*, 108*b*), using one or more elastic type straps 110*a* (so that the tongue element 110 is fixed to the edge(s) but can still be stretched forward with respect to the opening area), or in other manners. As other potential options, the tongue element 110 can be integrally joined along the side edges 108*a*, 108*b* and/or optionally made at least in part from a stretchable or extensible material, such as from a SPANDEX type stretchable/elastomeric fabric (e.g., like an internal bootie element), with a gusseted construction along at least one of the side edges 108*a*, 108*b*, etc.

Figure 3A:
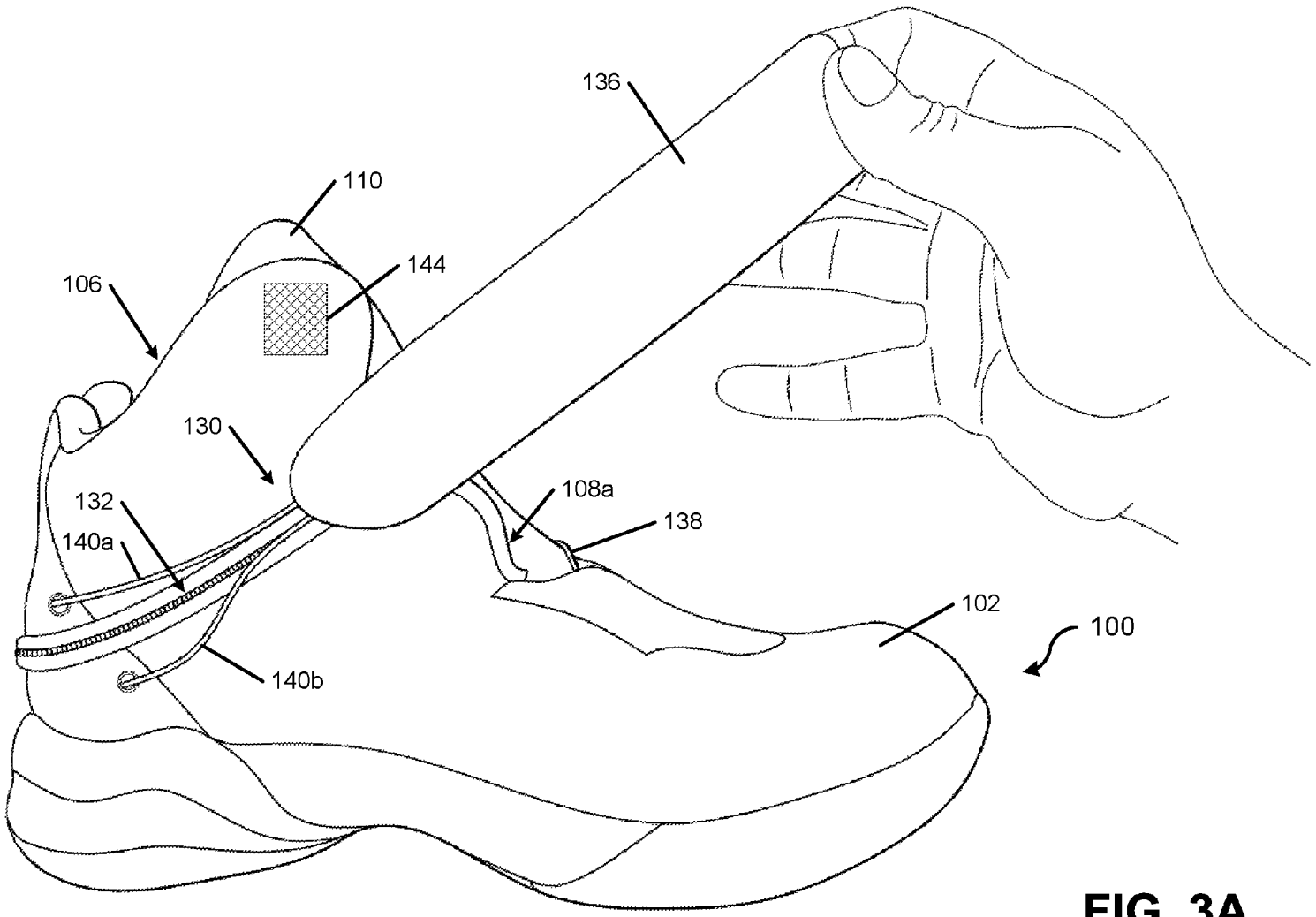
FIG. 3A includes a view illustrating engaging the article of footwear of FIGS. 1A through 1E with a wearer's foot in accordance with at least some aspects of this invention.

Once the shoe 100 is positioned on the foot, the strap 136 can be pulled forward and upward as shown in FIG. 3A, which action moves the slider 134 of the zipper system 132 up the zipper track toward the open end 120*a* of the foot insertion opening 120, to thereby close the foot insertion opening 120. The strap 136 then can be pulled tight and wrapped around the front of the ankle/leg, over the first and second side edges 108*a*, 108*b*, and secured at the opposite side of the upper 102 from the main part of the zipper element 132 (e.g., using hook-and-loop fastener 146). This strap 136 tightening action also may, at least in part, tighten the lace element 138 across the instep area of the shoe 100 (if the strap 136 and elastic members 140*a*, 140*b* are operatively coupled with the lace element 138).

While the embodiment shown in FIGS. 1A through 3A show the shoe 100 with the zipper element 132 primarily on the medial side of the upper 102 (and the strap 136 wrapping from the medial side to the lateral side), the opposite configuration also is possible (with the zipper element 132 primarily on the lateral side of the upper 102 and the strap 136 wrapping from the lateral side to the medial side). As another potential option, if desired, one shoe 100 of a pair of shoes may have the zipper element 132 primarily on the medial side of the upper 102 (and the strap 136 wrapping from the medial side to the lateral side) and the other shoe of the pair may have the opposite configuration (with the zipper element 132 primarily on the lateral side of the upper 102 and the strap 136 wrapping from the lateral side to the medial side).

Figure 3B:
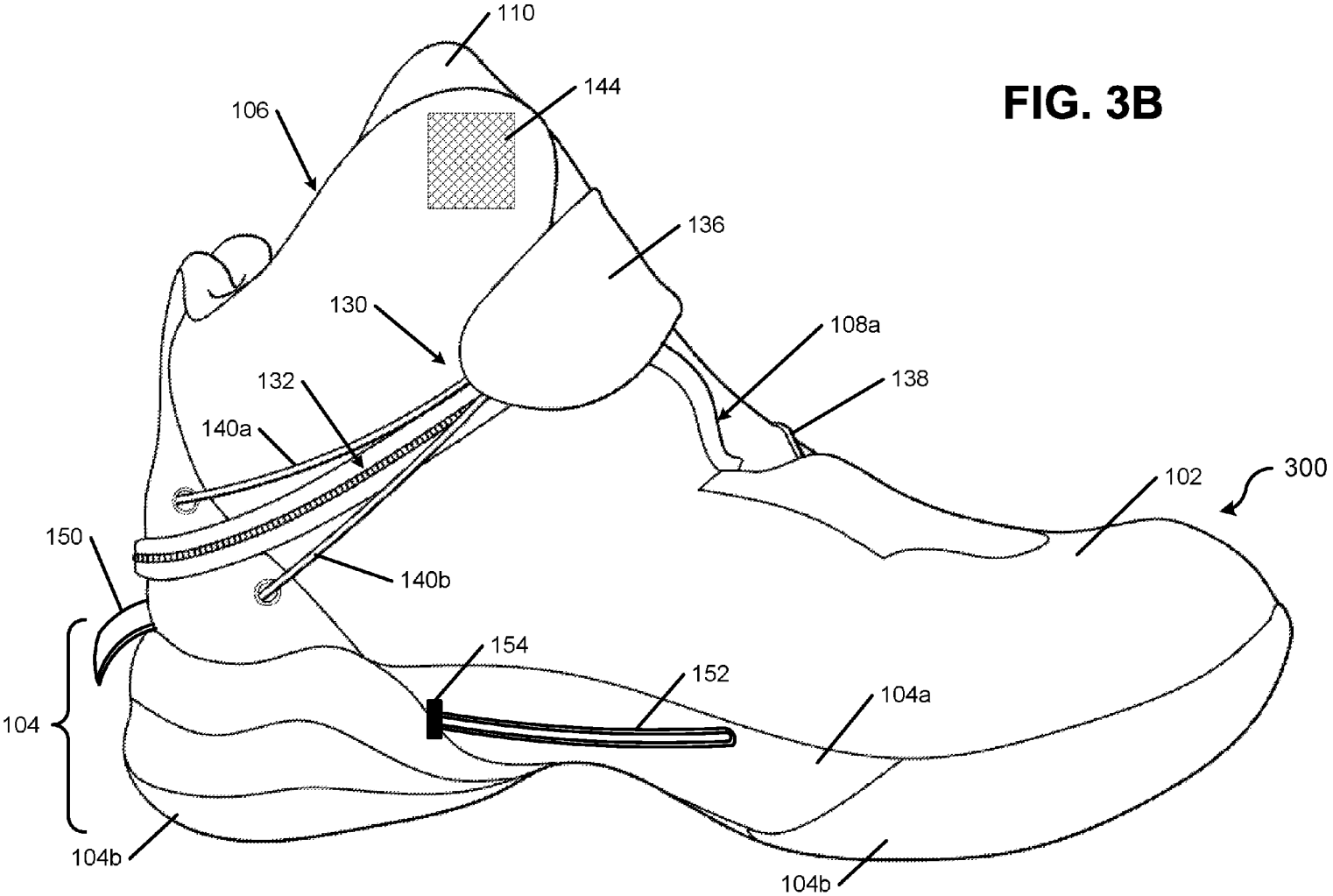
FIGS. 3B and 3C illustrate additional features and structures that may be included in articles of footwear in accordance with some examples of this invention.
Figure 3C:
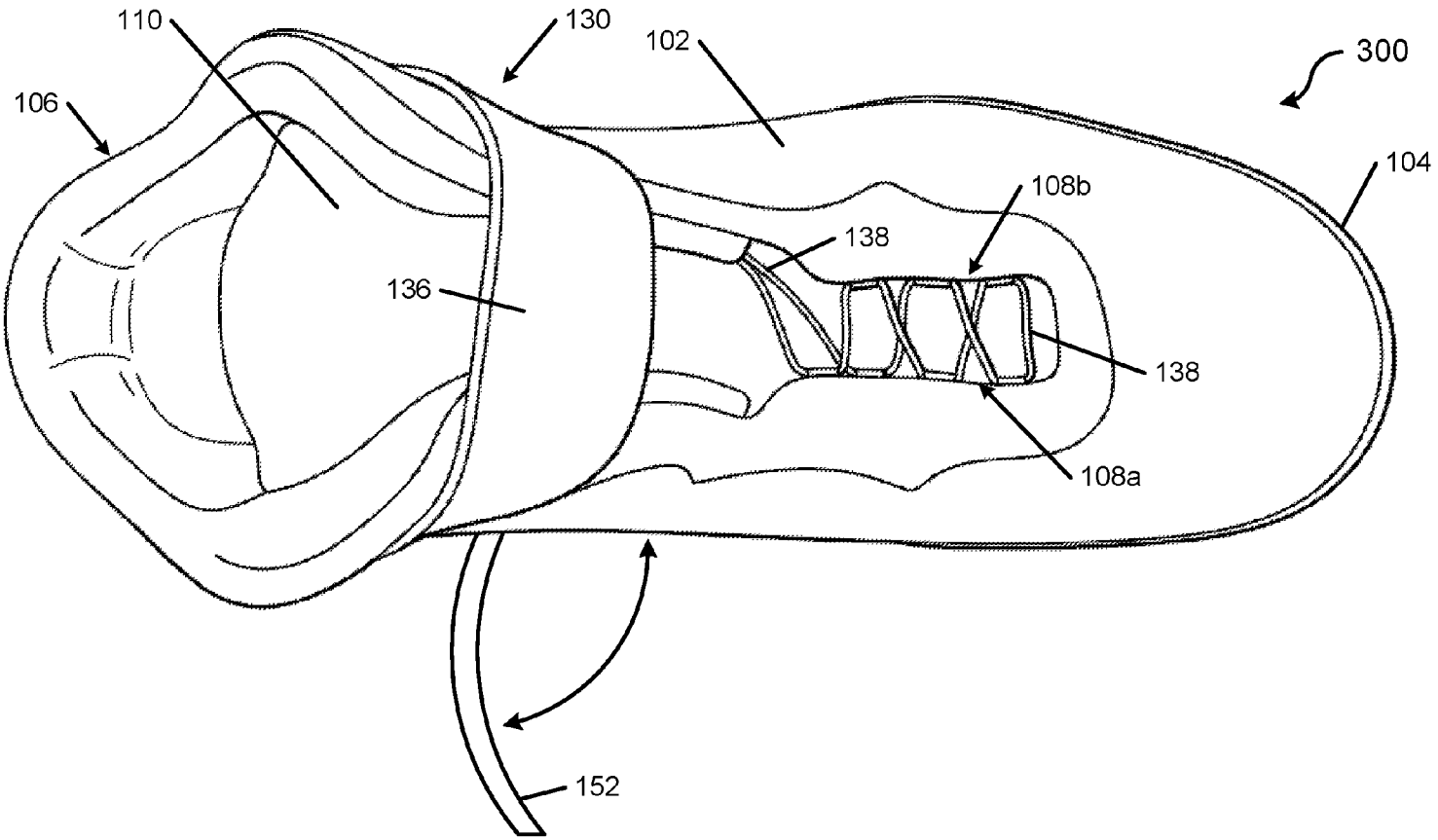

Optionally, if desired, and as illustrated in FIG. 3B, the rear heel area of the sole 104 and/or the upper 102 may include a handle or tab 150 that the user can grasp to help pull the shoe 100 all the way onto the foot (and get the toes down to the end of the shoe 100). Other structures may be provided for this purpose, if desired. For example, the handle or tab 150 may be shaped and positioned (e.g., of sufficient length to contact the floor) so that the user can step down on it (or otherwise apply force to it) to hold the shoe 100 in place while toes of the foot being inserted are pushed into the upper 102. As another example, as shown in FIGS. 3B and 3C, the upper 102 or sole structure 104 may include a bearing element 152 along a side that extends sideways to allow a rearward force to be applied to the shoe 100 (e.g., by the opposite foot or leg; by a wall, table, or chair; etc.). Optionally, this type of bearing member 152 may be mounted to fold forward along the side of the upper 102 and/or sole structure 104, e.g., on a hinge 154, or to retract into the sole structure 104 (or between the upper 102 and the sole structure 104), e.g., by a spring loaded mount.

As mentioned above, if desired, at least some portions of the lace element 138 and/or the elastic members 140*a*, 140*b* may extend inside or between layers of the upper 102. As another option, if desired, these members may at least partially extend around the heel area of the shoe 100 around the exterior surface of the upper 102. In such structures, at least some portions of the lace element 138, the elastic members 140*a*, 140*b*, and even the strap 136 may extend through a guide system 160. The guide system 160 can help maintain the lace element 138, the elastic members 140*a*, 140*b*, and/or the strap 136 in desired position(s) with respect to the upper 102 and/or help maintain a clear path so that these components can be pulled tight when securing the shoe 100 to a wearer foot. The guide system 160 also can help conceal these components to avoid unnecessary or undesired contact and/or interaction with other objects.

FIGS. 4A through 4D show cross sectional views of various potential examples of guide element 160 structures. The guide element(s) 160 may be provided along at least portions of the desired tracks of lace element 138, elastic members 140*a*, 140*b*, and/or strap 136, as shown in dash-double dot lines in FIGS. 1A, 1B, and 1D.

Figure 4B:
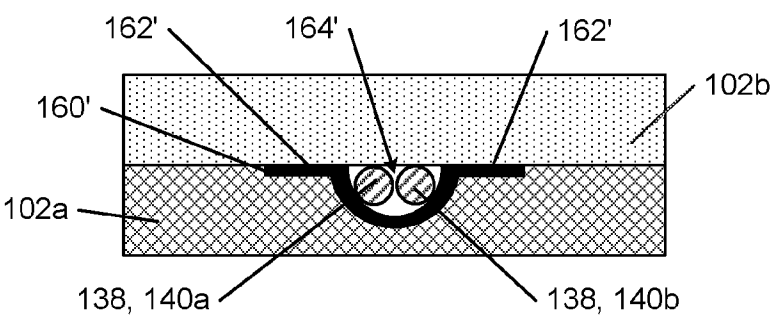
FIGS. 4A through 4D illustrate example structures of guide members that may be included with article of footwear structures in accordance with at least some examples of this invention.
Figure 4A:
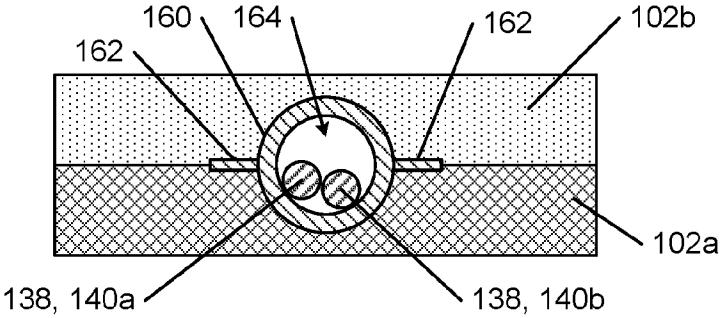

FIG. 4A shows a guide member 160 provided as a tubular member between two layers 102*a* and 102*b* of upper material (e.g., between a spacer mesh inner layer and an abrasion resistant TPU or synthetic leather outer layer). The guide member 160 may be made from a rigid or flexible material, e.g., plastic, fabric, or textile materials. The guide member 160 further may include structures 162 that enable the guide member 160 to be engaged with one or both of the upper layers 102*a*, 102*b*, e.g., such as by sewing or stitching, by adhesives or cements, by fusing techniques, etc. An internal area 164 defined by the guide member 160 houses at least portions of the lace element 138 and/or elastic members 140*a*, 140*b* (and/or optionally, at least a portion of the strap 136), depending on the location of the guide member 160 around the shoe 100.

FIG. 4B shows a similar two layer upper construction in which the guide member 160' has an open side and a surface of one of the upper layers (e.g., layer 102*b*, in this example) defines one side of the guide member internal area 164' (in which the elements 138, 140*a*, and/or 140*b* are contained). Again, the guide member 160' may be engaged with one or both of the upper layers 102*a*, 102*b*, e.g., at structures 162', such as by sewing or stitching, by adhesives or cements, by fusing techniques, etc.

Figure 4D:
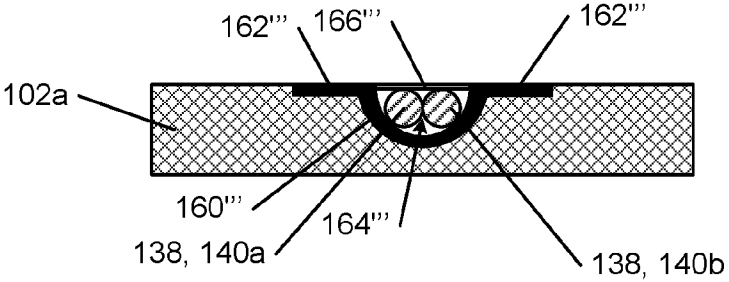
Figure 4C:
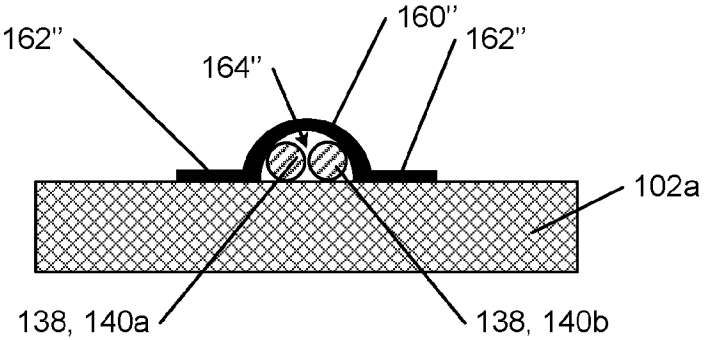

FIG. 4C shows a guide member 160" engaged with a single layer 102*a* of an upper. Again, the guide member 160" has an open side and a surface of upper layer 102*a* defines one side of the guide member internal area 164" (in which the elements 138, 140*a*, and/or 140*b* are contained). Again, the guide member 160" may be engaged with upper layer 102*a*, e.g., at structures 162", such as by sewing or stitching, by adhesives or cements, by fusing techniques, etc. In this example construction, the guide member 160" extends outward from the upper layer 102*a*, and the guide member 160" may be oriented on an interior or an exterior surface of this upper layer 102*a*.

FIG. 4D also shows a guide member 160''' engaged with a single layer 102*a* of an upper. In this example structure, a thin cover element 166 is provided along at least some portion of a longitudinal length of the guide member 160''' (to close off and partially define internal area 164''' in which the elements 138, 140*a*, and/or 140*b* are contained). This cover element 166 may be formed from any desired type of material, including, for example, a rigid or flexible polymeric material, a fabric or textile material, etc. Again, the guide member 160''' may be engaged with upper layer 102*a*, e.g., at structures 162''', such as by sewing or stitching, by adhesives or cements, by fusing techniques, etc. In this example construction, the guide member 160''' extends or recesses into the upper layer 102*a*, and the guide member 160''' may be oriented on an interior or an exterior surface of this upper layer 102*a*. In some structures, if desired, the cover element 166 may be omitted, at least over some portions of the guide member structure 160'''.

While always shown including two elements 138, 140*a*, and/or 140*b* in FIGS. 4A through 4D, guide elements of any of these types may include a single portion of the closure/securing system 130 or more than two components. For example, as shown in FIGS. 1A, 1B, and 1D, the guide member may divide or separate at the rear heel portion (or other portion) of the shoe structure 100, and a single element 138, 140*a*, and/140*b* may be provided in at least some of the guide members (e.g., on opposite sides of zipper system 132). The guide system need not extend continuously along the entire path shown in FIGS. 1A, 1B, and 1D, but it may be discontinuous (e.g., in multiple separate parts, e.g., akin to belt loop type structures) or otherwise shorter than the entire path.

If necessary or desired, in any of the constructions of FIGS. 4A through 4D, the interior wall of internal area 164, the elements 138, 140*a*, and/or 140*b*, the cover element 166, and/or the surface of the upper 102 defining the internal area 164 may be treated so as to reduce sliding friction between the various parts contained in the internal area (e.g., so that the elements 138, 140*a*, and/or 140*b* move more freely and easily when pulled or released). As some more specific examples, if desired, the treatment may include a polytetrafluoroethylene coating or infusion, graphite coating or infusion, treatment with other lubricants, etc. Additionally or alternatively, if desired, at least portions of the internal wall of the internal area 164 of the guide element 160, the cover member 166, and/or the surface of the upper 102 may be made from a material having a low coefficient of friction with respect to elements 138, 140*a*, and/or 140*b*. The elements (e.g., 138, 140*a*, 140*b*) contained within the internal area 164 may be made from materials or treated to have a low coefficient of friction with respect to one another (or with respect to other surfaces and/or structures within internal area 164). These features can help prevent elements 138, 140*a*, and/or 140*b* from binding and/or sticking when the closure/securing system 130 is tightened or released.

In footwear structures 100 in which instep securing element(s) (e.g., non-elastic or unstretchable lace elements 138) directly engage with the pull strap 136 (e.g., via elastic stretch components 140*a*, 140*b*), the location of the transition between the unstretchable lace elements 138 and the elastic pull strap components 140*a*, 140*b* may occur at any desired location around the upper structure 102. As some more specific examples, this transition may occur in the lateral side heel area (e.g., see FIG. 1A, point $P_4$), in the rear heel area (e.g., FIG. 1D, points $P_5$), or even in the medial side heel area (e.g., FIG. 1B, points $P_6$). This transition also may occur within the guide elements 160 (if any), between layers of the upper 102 (if multiple layers are present), inside the upper 102, and/or outside of the upper 102. When two or more securing component (138, 140*a*, 140*b*) paths are provided around the upper 102, the transition(s) between unstretchable and elastic materials (if any) may occur at the same or different locations around the upper 102.

Figure 5:
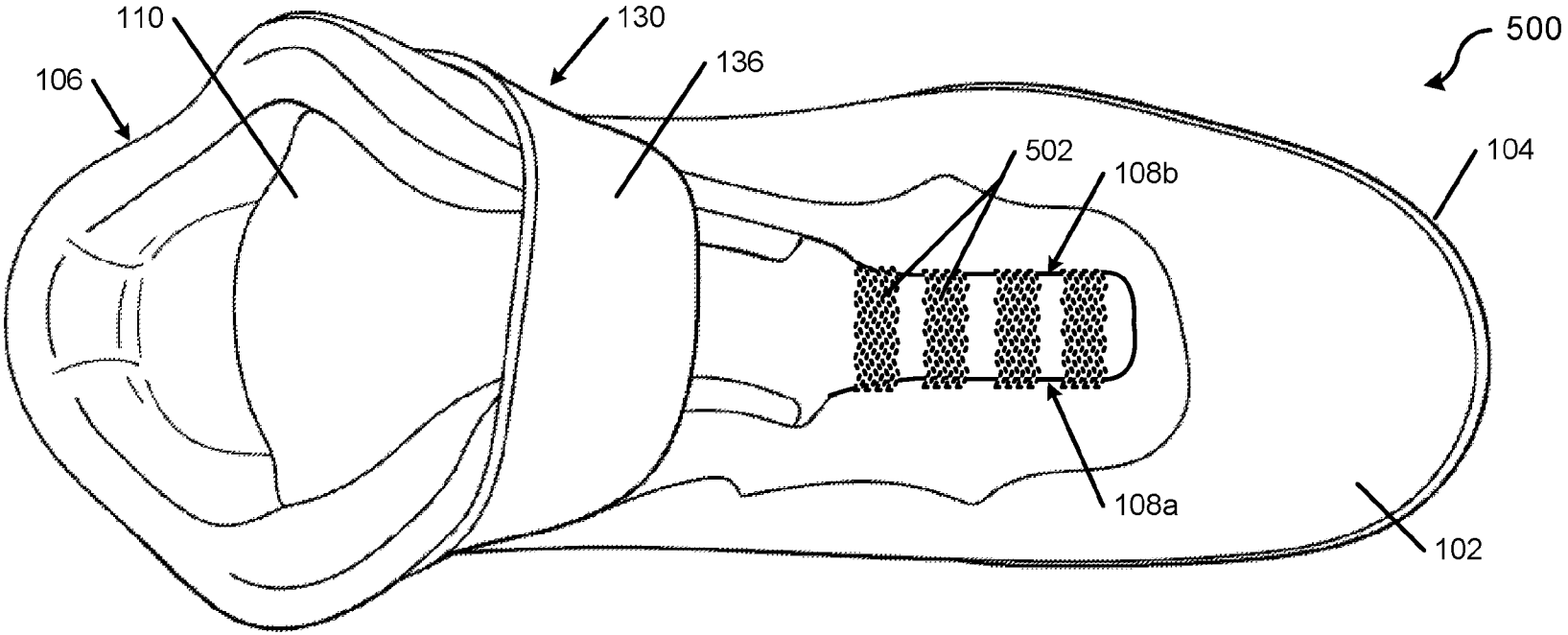
FIG. 5 provides a top view of another example article of footwear in accordance with some aspects of this invention.

FIG. 5 illustrates another example article of footwear structure 500 in accordance with some examples of this invention. While the footwear structure 500 of FIG. 5 is similar to that of FIGS. 1A through 1D, in this illustrated example structure 500, the lace elements 138 from FIG. 1C are replaced by one or more stretchable or elastic bands 502 that extend across the instep opening from side edge 108*a* to side edge 108*b*. The elastic band(s) 502 allow the size of the instep area of the shoe 500 to expand as the foot moves inward and then return to or toward their original size to help maintain the shoe in a tightened condition on the wearer's foot. If desired, elastic bands 502 may engage straps 138*a* for wrap-around and adaptive fit type components of the types described above in conjunction with FIG. 1C (and as described in U.S. Patent Appln. Publ. Nos. 2012/0011744 and 2012/0198720).

In this example structure 500, the strap 136 still is engaged with a slider element 134 of zipper system 132 and is mounted on one or more elastic elements 140*a*, 140*b* that extend at least partially around the wearer's foot to help secure the shoe to the wearer's foot. The elastic element(s) 140*a*, 140*b* in this illustrated example shoe structure 500, however, do not extend around to and/or engage the closure/securing element(s) 502 provided at the instep area of the shoe. Rather, in this shoe structure 500, the elastic element(s) 140*a*, 140*b* are fixed to one of the upper 102 and/or the sole structure 104 and/or held between the upper 102 and sole structure 104. The fixing point for the end(s) of elastic element(s) 140*a*, 140*b* may be at any desired location around the shoe structure 500, such as in the lateral heel area, in the rear heel area, and/or in the medial heel area, etc. (e.g., in the general areas designated as points $P_4$, $P_5$, and $P_6$ in the discussion above with respect to FIGS. 1A through 1E, between the upper and the sole structure, etc.). Additionally or alternatively, if desired, the strap 136 could be made at least partially from a stretchable material and used to tighten the shoe 500 to the wearer's leg.

The shoe 500 of FIG. 5 may include strap 136, zipper system 132, and/or elastic elements 140*a*, 140*b* of the types described above in FIGS. 1A through 1D, and these components may operate in a manner the same as or similar to those described above for the structure 100 of FIGS. 1A through 1D (e.g., as described in conjunction with FIGS. 2A-3A) except loosening of the strap 136 and relaxation of the tensile force in elements 140*a*, 140*b* will not affect tightness across the instep area. Nonetheless, the zipper system 132 and the closure system 130 may be opened and closed in the same general manner.

Those skilled in the art will understand that the structures, options, and/or alternatives for the footwear structures described herein, including the features of the various different embodiments of the invention, may be used in any desired combinations, subcombinations, and the like, without departing from the invention. For example, if desired, the elastic band(s) 502 of FIG. 5 may be used in conjunction with the lace element 138 of FIGS. 1A through 3A. As another example, the footwear structure 500 of FIG. 5 may include the handle and/or bearing members of FIGS. 3B and 3C without departing from this invention. The example footwear structure 500 of FIG. 5 also may include one or more of the guide element structures 160 and arrangements as shown in FIGS. 4A through 4D, if desired. Other combinations of specific features, components, and combinations also may be used without departing from this invention.

Further variations from the illustrated structures may be made in the closure/securing system 130. As some additional examples, if desired, more or fewer (or no) elastic bands 140*a*, 140*b* may be provided without departing from this invention. Additionally or alternatively, the elastic bands 140*a*, 140*b*, when present, may have different sizes, cross sectional shapes, attachment location(s) to the strap 136, and the like from the specifically illustrated structures, and the bands 140*a*, 140*b* on a single shoe 100 (when multiple bands are present) may have the same or different constructions. The band(s) 140*a*, 140*b* also may extend around the shoe 100 in different directions from those illustrated, including at different relative directions and/or angles from one another. The band(s) 140*a*, 140*b* need not extend inside and/or between layers of the upper 102 as shown in FIG. 1B, but if they do, the location(s) at which the band(s) 140*a*, 140*b* move from an exterior location to an interior location with respect to the upper 102 may vary (e.g., the location(s) may be nearer to the strap 136, at higher and/or lower locations with respect to the zipper system 132, further around the rear heel area, more toward the opposite side of the shoe, at wider spaced apart locations around the perimeter, etc.). Also, the entry location for the band(s) 140*a*, 140*b* (i.e., the opening through which the band(s) 140*a*, 140*b* extend inside the upper 102) may have shapes other than round, such as square, rectangular, triangular, other polygonal shapes, oval or elliptical shaped, star shaped, cross shaped, logo shaped, irregularly shaped, etc. More than one band 140*a*, 140*b* may extend through a single opening to the interior of the upper 102, if desired (e.g., at a location beyond the end of the zipper system 132). When multiple openings for this purpose are present in a shoe construction, the individual openings may have the same or different shapes from one another. The strap 136 also may be sized, shaped, and oriented differently from the illustrated structures and arrangements, if desired. The various options noted above also may be used in any desired combinations or subcombinations without departing from this invention. Accordingly, a wide variety of options and design choices are available for the various structures of the closure/securing system 130.

The lace component 138 and its orientation on a shoe also may differ without departing from this invention. For example, as noted above, the lace component 138 may engage more conventional eyelets or holes through the upper 102 at the instep area. The lace component 138 also may have different sizes, cross sectional shapes, and/or cross the instep area of the shoe 100 a different number of times from that shown without departing from this invention. Also, while the shoe 100 of FIG. 1C shows both ends of lace component 138 extending inside the upper 102 at the lateral side of the shoe 100, other arrangements are possible without departing from this invention. For example, both ends of lace component 138 could extend inside the upper 102 at the medial side of the shoe 100. As another example, the opposite ends of lace component 138 could extend inside the upper 102 at opposite sides of the shoe 100 (and potentially engage different straps 136 or one of the ends of the lace component 138 could wrap around a direction change element provided on or with the shoe 100 to change direction and engage the same strap 136 as the other end). As yet another example, if desired, the ends of lace component 138 could extend along the outside of the upper 102 (on one or both sides, optionally at least partially within a guide member 160). Accordingly, many variations on the lace structure 138 and arrangement are possible without departing from this invention.

The tension applying systems (e.g., to tighten lace element 138 and/or strap 136) also may have other structures without departing from this invention. For example, a pulley doubler type system may be provided, e.g., to reduce the pulling force needed to apply tensile force to the lace element 138. As additional options, other tension applying devices could be provided, e.g., at the front, instep, and/or side ankle areas of the shoe 100, such as a rotary "take up" mechanism that winds to roll up excess lace element 138 (and thereby apply tensile force to the lace element 138). Such tension applying devices may replace the strap 136 and elastic bands 140*a*, 140*b*, in at least some footwear structures and/or they may be engaged with the zipper slider 134, if desired, to pull the zipper slider 134 downwardly and rearwardly when the tension is released (e.g., to perform the tension release functions with respect to the zipper slider 134 described above in conjunction with FIG. 2A).

Figure 6A:
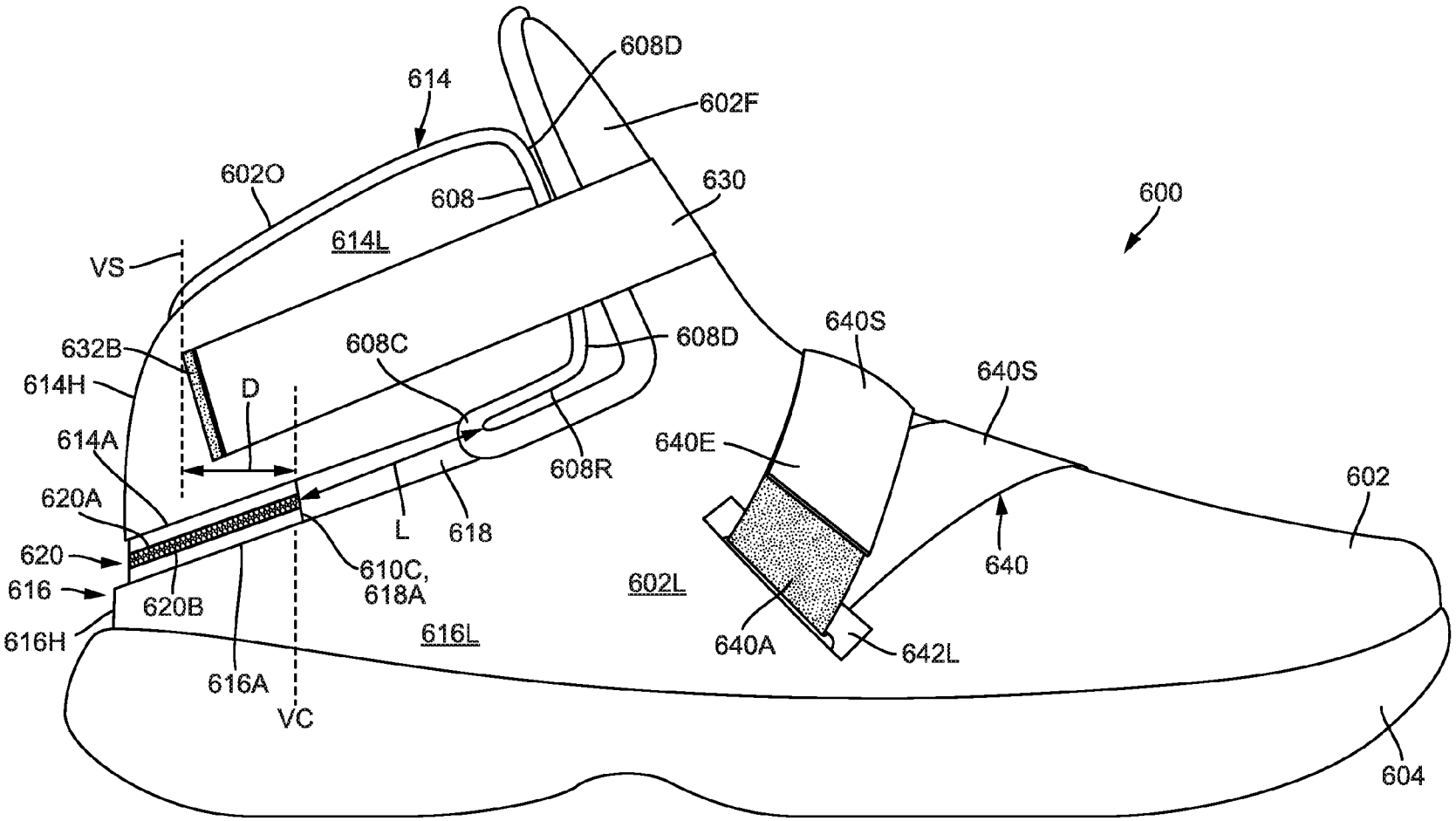
FIGS. 6A through 6I provide various views of another example article of footwear according to at least some examples and aspects of this invention.
Figure 6B:
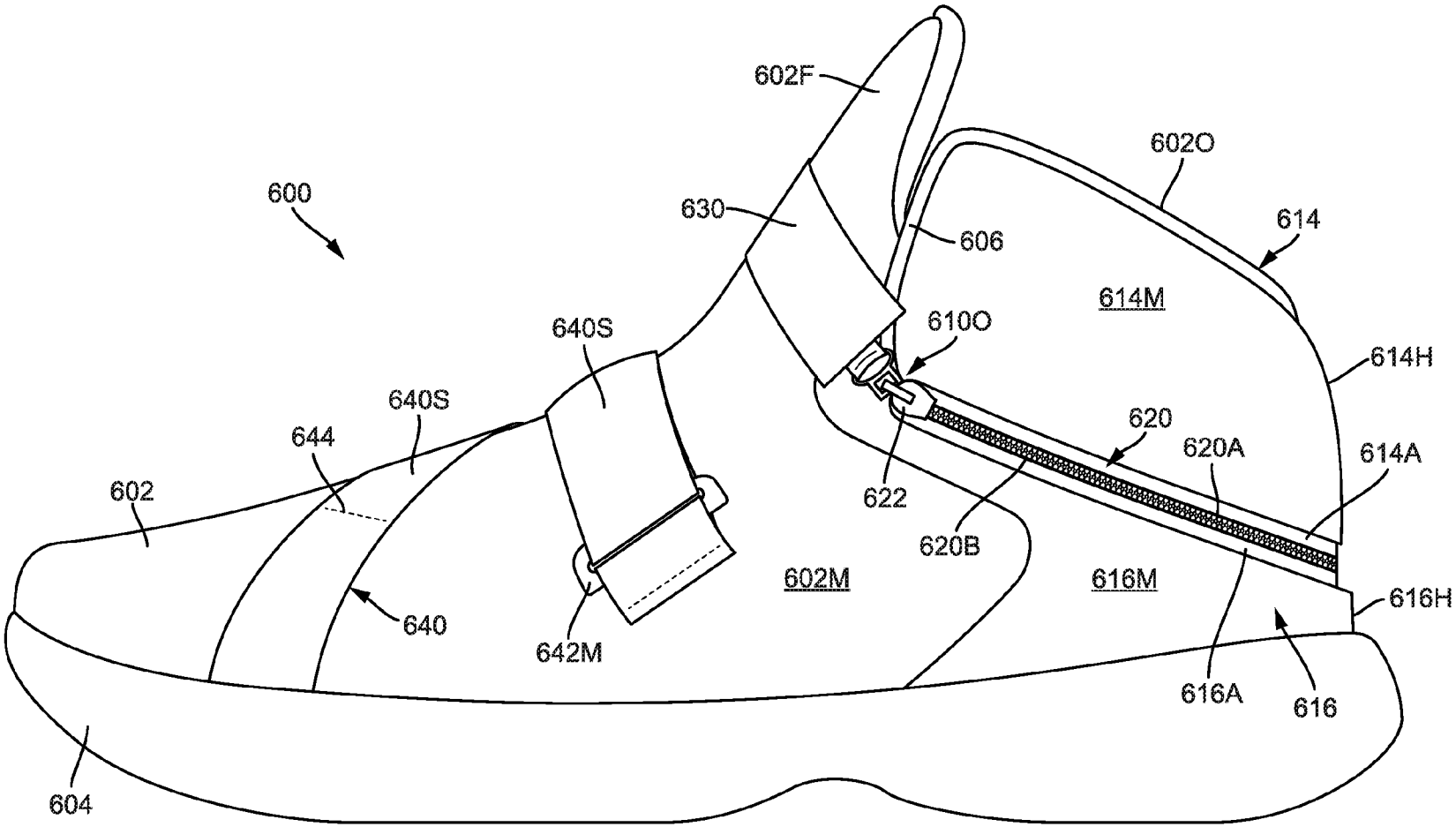
Figure 6C:
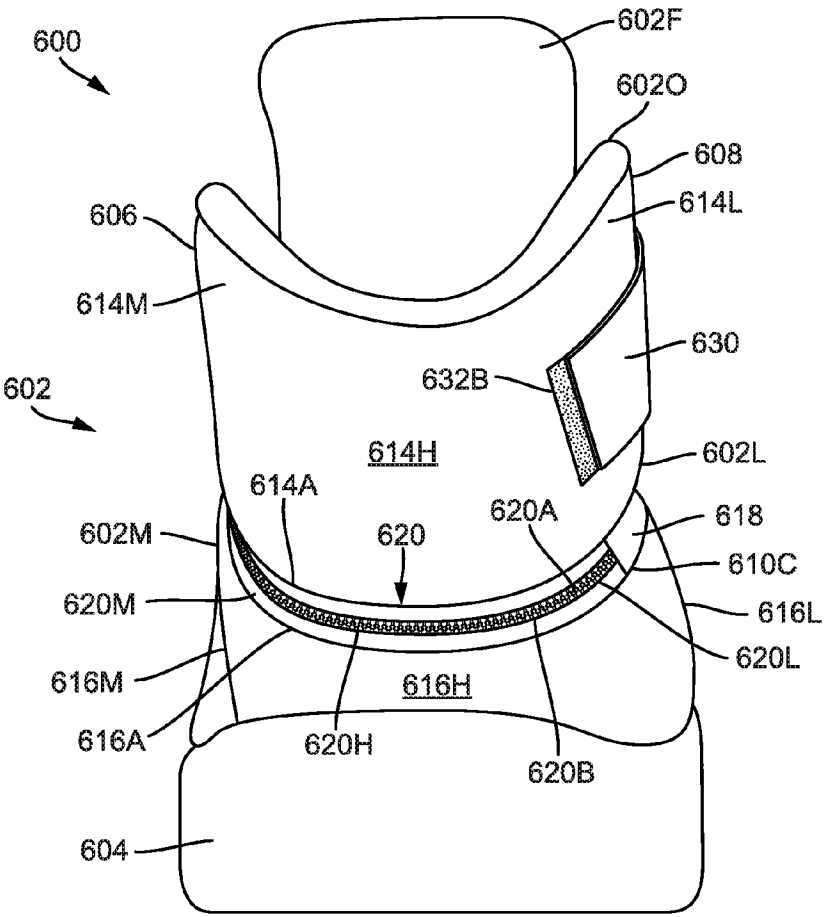
Figure 6D:
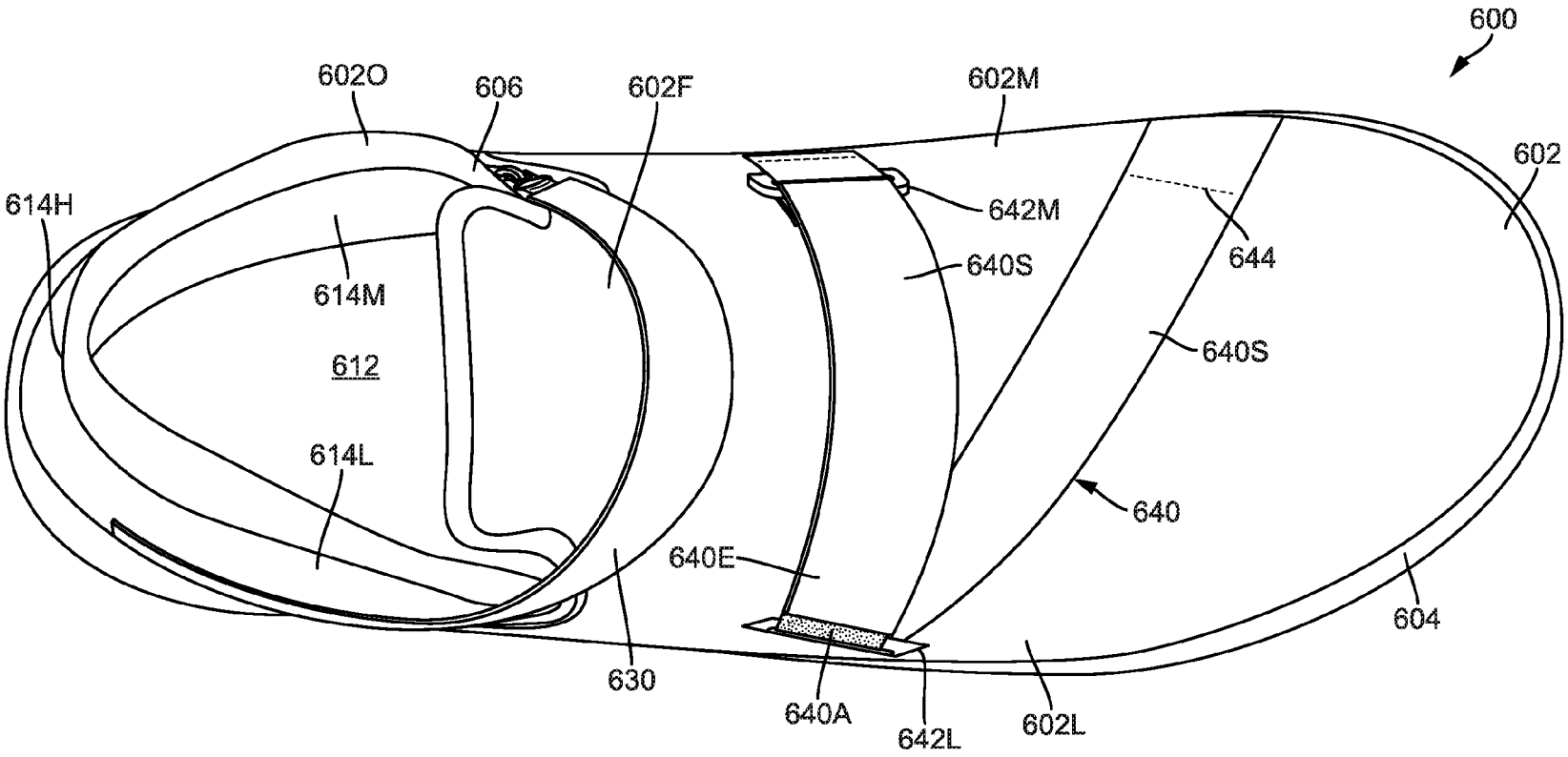
Figure 6E:
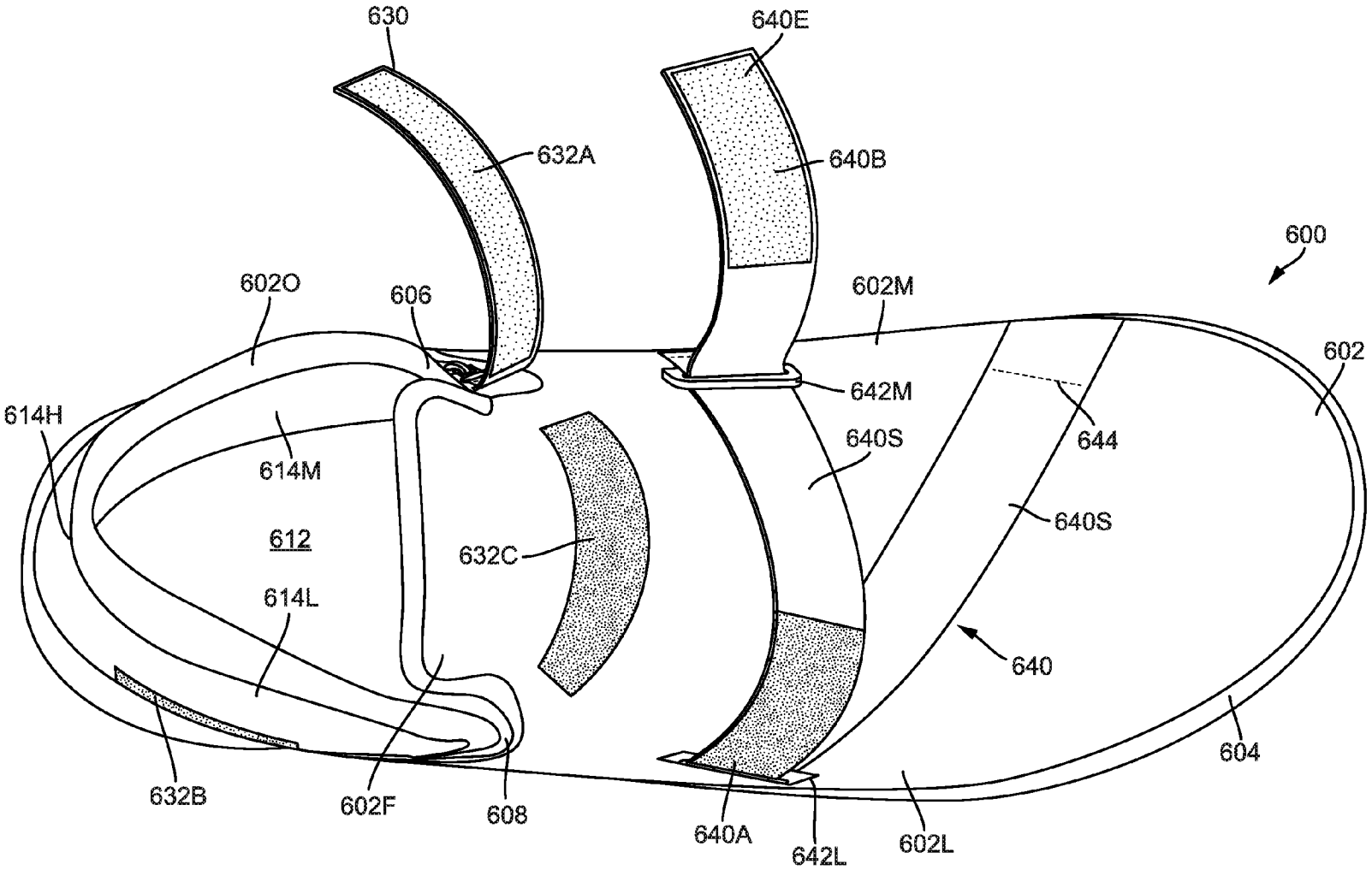

FIGS. 6A-6I illustrate another example article of footwear 600 in accordance with at least some aspects of this invention. This article of footwear 600 includes an upper 602 and a sole structure 604 engaged with the upper 602 (e.g., in conventional manners and/or from conventional materials and constructions as are known and used in the footwear arts). FIGS. 6A-6D show various views of the article of footwear 600 and upper 602 in a "closed" condition and/or a foot engaging configuration; FIG. 6E shows two securing systems on the article of footwear open (they are closed in FIGS. 6A-6D); and FIGS. 6F-6I show various views of the article of footwear 600 and upper 602 in an "open" condition and/or a foot insertion configuration. While called a "foot insertion configuration" in this specification, those skilled in the art, given benefit of this disclosure, would recognize that the foot insertion configuration also may be used when a wearer's foot is removed from the upper 602 (also called a "foot removal configuration" herein). The upper 602 and sole member 604 may have any of the features/characteristics described above for the structures of FIGS. 1A-5.

The example upper 602 shown in these figures includes a top opening 602O, a first side 602M (e.g., a medial side), and a second side 602L (e.g., a lateral side) opposite the first side 602M. At the first side 602M, a first side edge 606 extends downward from the top opening 602O, and at the second side 602L, a second side edge 608 extends downward from the top opening 602O. This example upper 602 defines a foot insertion opening that extends from the first side edge 606 (note openable end 610O of the foot insertion opening) and terminates at a closed end 610C located at a side heel area of the upper 602 on the second side 602L of the upper 602 (e.g., optionally corresponding to point $P_{LH}$ from FIG. 1A). A closure system 620 is engaged with the upper 602 for releasably closing the foot insertion opening, and the closure system 620 of this example extends between the closed end 610C of the foot insertion opening and the first side edge 606 of the upper 602 (e.g., at least along a majority of the length of the opening from the open end 610O to the closed end 610C, and in some examples, along at least 70%, at least 90%, or even at least 95% of this length). The closure system 620 may include a zipper system or other desired hardware system for selectively opening and closing the foot insertion opening, some examples of which will be described in more detail below.

As further evident from FIGS. 6A-6I, this illustrated upper 602 (optionally in combination with the sole structure 604) at least in part defines a foot-receiving volume 612 configured to receive a wearer's foot in use. The upper 602 of this example is structured to include: (a) an ankle containing portion 614 having a first side 614M, a rear heel area 614H, and a second side 614L and (b) a base portion 616 having a first side 616M and a second side 616L (and optionally a rear heel portion 616H). The base portion 616 may remain fixed (or substantially fixed) in location with respect to the sole structure 604, while the ankle containing portion 614 may be movable with respect to the base portion 616 and the sole structure 604, as will be described in more detail below. In this illustrated example, a connecting member 618 connects the second side 614L of the ankle containing portion 614 and the second side 616M of the base portion 616.

In use, and considered when the sole structure 604 is supported on a horizontal support surface, the upper 602 is changeable, e.g., by movement of the ankle containing portion 614 with respect to the base portion 616 (and the sole structure 604) at the connecting member 618 between: (a) a foot engaging configuration (FIGS. 6A-6D) in which the first side 614M of the ankle containing portion 614 of the upper 602 is positioned over the first side 616M of the base portion 616 (and over the sole structure 604) to close the upper 602 and (b) a foot insertion configuration (FIGS. 6F-6I) in which the first side 614M of the ankle containing portion 614 of the upper 602 is moved, e.g., to be positioned laterally/sideways outside of the second side 616L of the base portion 616 and/or laterally/sideways outside of the connecting member 618 with respect to the foot-receiving volume 612 of the upper 602, to thereby open a rear heel area of the upper 602. In the foot insertion configuration, the first side 614M of the ankle containing portion may be located to a side of the sole structure 604. The closure system 620 may be used to releasably hold the upper 602 in the foot engaging configuration and to open the upper 602. In the foot engaging configuration, the foot insertion opening is in a "closed condition" and in the foot insertion configuration, the foot insertion opening is in an "open condition."

As evident from the FIGS. 6A-6I, in the foot insertion configuration/open condition, the ankle containing portion 614 of uppers 602 in accordance with at least some examples of this invention will move to one side (e.g., the lateral side) to open the rear heel area of the upper very wide and low. These features can enable easy insertion of a wearer's foot, generally from the rear of the footwear structure 600. Additional example features of this example upper 602/article of footwear 600 will be described below.

Figure 6F:
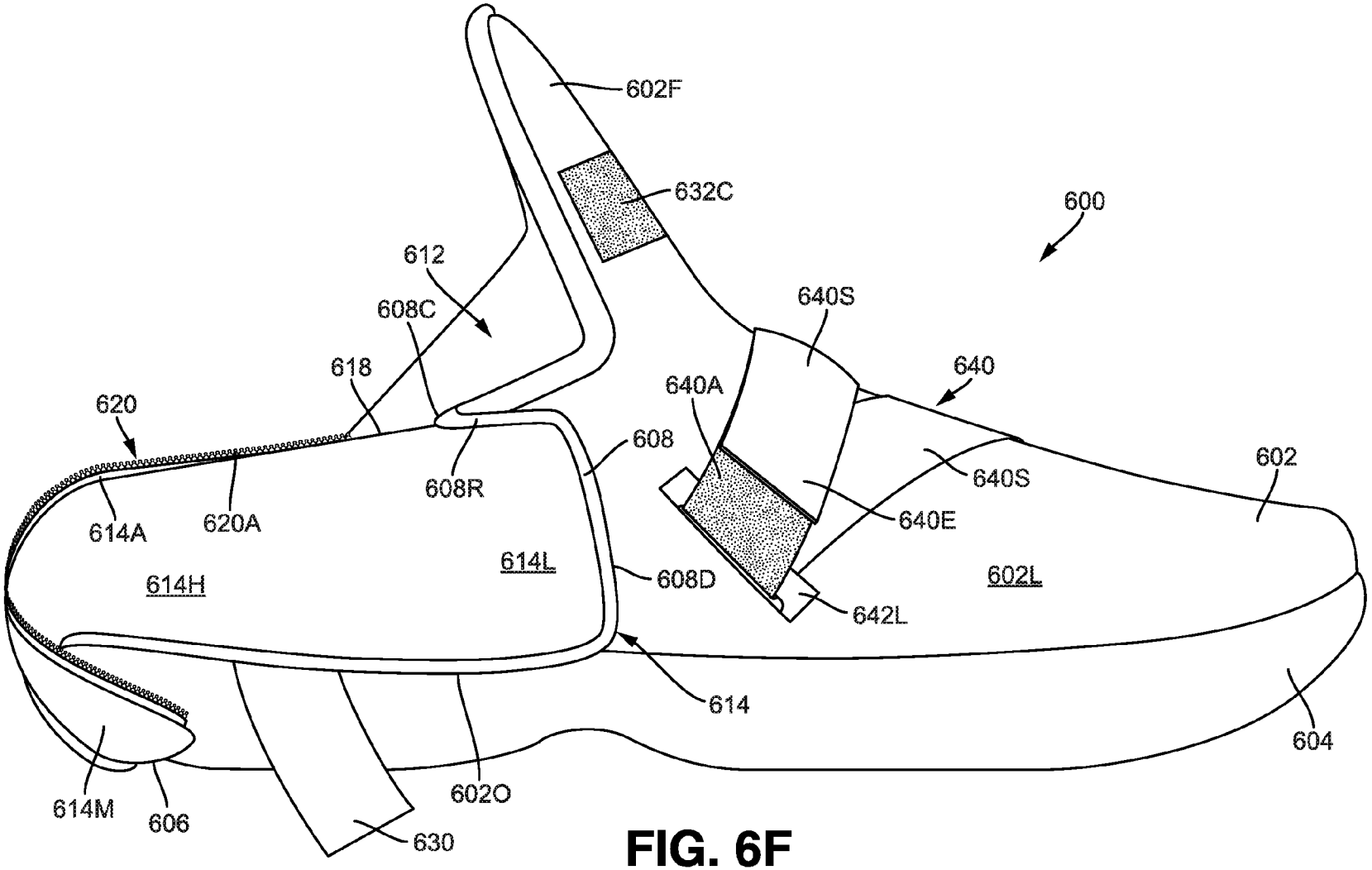
Figure 6G:
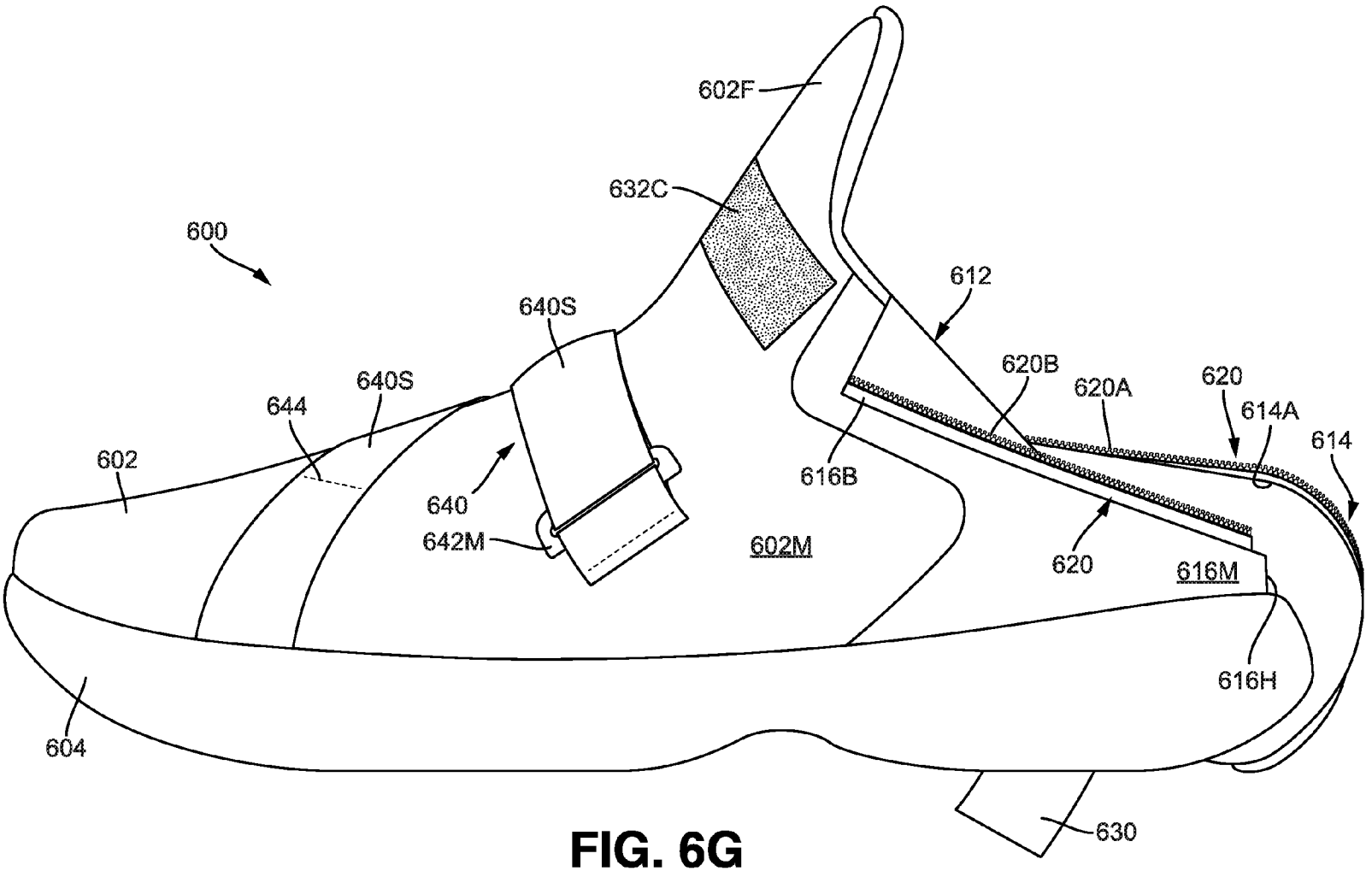

For example, as shown in FIGS. 6A and 6F, in this illustrated example, the second side edge 608 (part of the ankle containing portion 614) includes a downward extending segment 608D and a rearward extending segment 608R. This example rearward extending segment 608R of the second side edge 608 terminates at a closed end 608C, e.g., located at one side 618B of the connecting member 618. As shown in FIG. 6A, the closed end 608C of the second side edge 608 may be located a shortest direct line distance L from the closed end 610C of the closure system 610 and/or foot insertion opening. While other dimensions are possible, in at least some examples of this invention, the distance L may be within a range from 5 mm to 80 mm, and in some examples from 10 mm to 70 mm, from 12 mm to 55 mm, or even from 15 mm to 45 mm.

Example ankle containing portions 614 of uppers 602 according to still other aspects of this invention may include: (a) a top edge (e.g., 602O); (b) a first edge (e.g., 606) extending from the top edge 602O, along the first side 614M of the ankle containing portion 614, around the rear heel area 614H of the ankle containing portion 614, to the second side 614L of the ankle containing portion 614, and to a first side 618A of the connecting member 618; and (c) a second edge (e.g., 608) extending from the top edge 602O, along the second side 614L of the ankle containing portion 614, and to a second side 618B of the connecting member 618. The second edge 608 of the ankle containing portion 614 may include the downward extending segment 608D and the rearward extending segment 608R that extends to the second side 618B of the connecting member 618, as described above. A length dimension of the connecting member 618 measured as a shortest direct distance from the first side 618A to the opposite second side 618B of the connecting member 618 may be within a range from 5 mm to 80 mm, and in some examples from 10 mm to 70 mm, from 12 mm to 55 mm, or even from 15 mm to 45 mm.

The connecting member 618 may have any desired construction without departing from this invention, e.g., provided it can support the desired changes between: (a) the foot engaging configuration and/or "closed condition" and (b) the foot insertion configuration and/or "open condition" described above. As one more specific example, as shown in FIG. 6A, the connecting member 618 may be a strip or section of material (e.g., a fabric, a textile, leather, polymeric material, etc.) attached to the upper 602 (e.g., attached to the ankle containing portion 614 and the base portion 616 described above). This strip or section of material may extend from: (a) the closed end 610C of the foot insertion opening and/or closure system 610 to (b) the closed end 608C of the rearward extending segment 608R of the second side edge 608. This strip or section of material for the connecting member 618 also may define one or both of: (a) the closed end 610C of the foot insertion opening and/or the closure system 610 and/or (b) the closed end 608C of the rearward extending segment 608R of the second side edge 608. As additional examples, the connecting member 618 may constitute a continuous strip or section of upper 602 material that forms at least one of the ankle containing portion 614 and/or the base portion 616 and extends between (and potentially helps define) the closed end 610C of the foot insertion opening and/or closure system 610 and/or the closed end 608C of the rearward extending segment 608R of the second side edge 608. Still additional potential examples of a suitable connecting member 618 include a mechanical hinge member, a plastic or polymeric member having one or more pre-formed "bend lines;" and/or other relative rotation supporting structures.

Additional potential features of example closure systems 620 now will be described in more detail. As shown in the figures, this example closure system 620 includes a track extending at least along the second side 602L of the upper 602 (e.g., when the upper/foot insertion opening is in the foot engaging configuration/closed condition). As a more specific example, one track portion 620A may extend along at least a portion or section of a lower edge 614A of the ankle containing portion 614 of the upper 602 and another (e.g., mating) track portion 620B may extend along at least a portion or section of an upper edge 616A of the base portion 616 of the upper 602. These track portions 620A, 620B may extend, for example, a majority, and in some examples, at least 70%, at least 90%, at least 95%, or even 100% of a length of the foot insertion opening, the lower edge 614A, and/or the upper edge 616A. As best shown in FIG. 6A, in this illustrated example, an end portion of the track 620 located along the second side 602L of the upper 602 may "substantially align" with an end portion and/or an extension direction of the rearward extending segment 608R of the second side edge 608 of the upper 602.

Figure 7B:
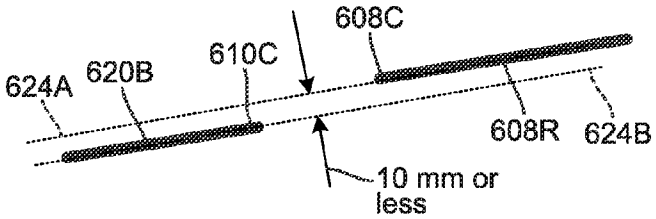
FIGS. 7A through 7D provide various views illustrating potential relative orientations of footwear parts/features in accordance with at least some examples of this invention.
Figure 7A:
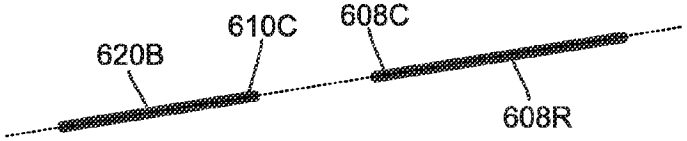
Figure 7D:
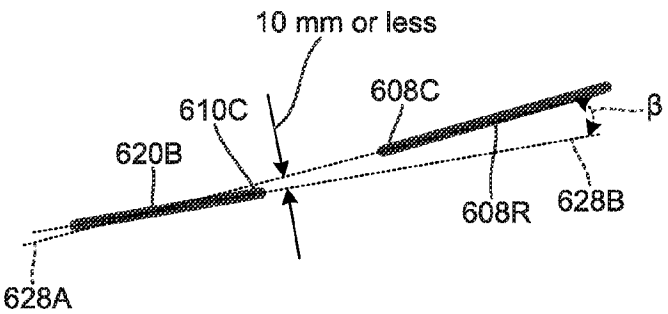
Figure 7C:
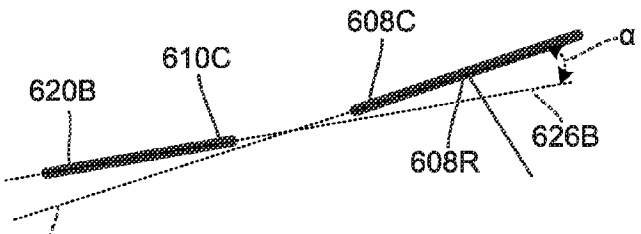

The term "substantially align" as used herein in this context means that the two features in question, e.g., (a) an end track portion or segment 620B along the second side 602L of the upper 602 and (b) an end of the rearward extending segment 608R of the second side edge 608 of the upper 602 in this example: (i) align (see FIG. 7A), (ii) are parallel and lie on lines 624A/624B located within 10 mm of one another (see FIG. 7B), (iii) lie on lines 626A/626B that intersect one another at an angle $\alpha$ of less than 5° at an intersection location between their ends 610C/608C (see FIG. 7C), or (iv) lie on lines 628A/628B that intersect at an angle $\beta$ of less than 5° and come within 10 mm of one another at a location between their ends 610C/608C (see FIG. 7D).

A closure element 622 (e.g., a zipper slider) is movable along the track, e.g., to selectively join or separate track portions 620A and 620B and to thereby respectively change the foot insertion opening between the open condition and the closed condition and/or to thereby respectively change the upper 602 between the foot engaging configuration and the foot insertion configuration.

Figure 6H:
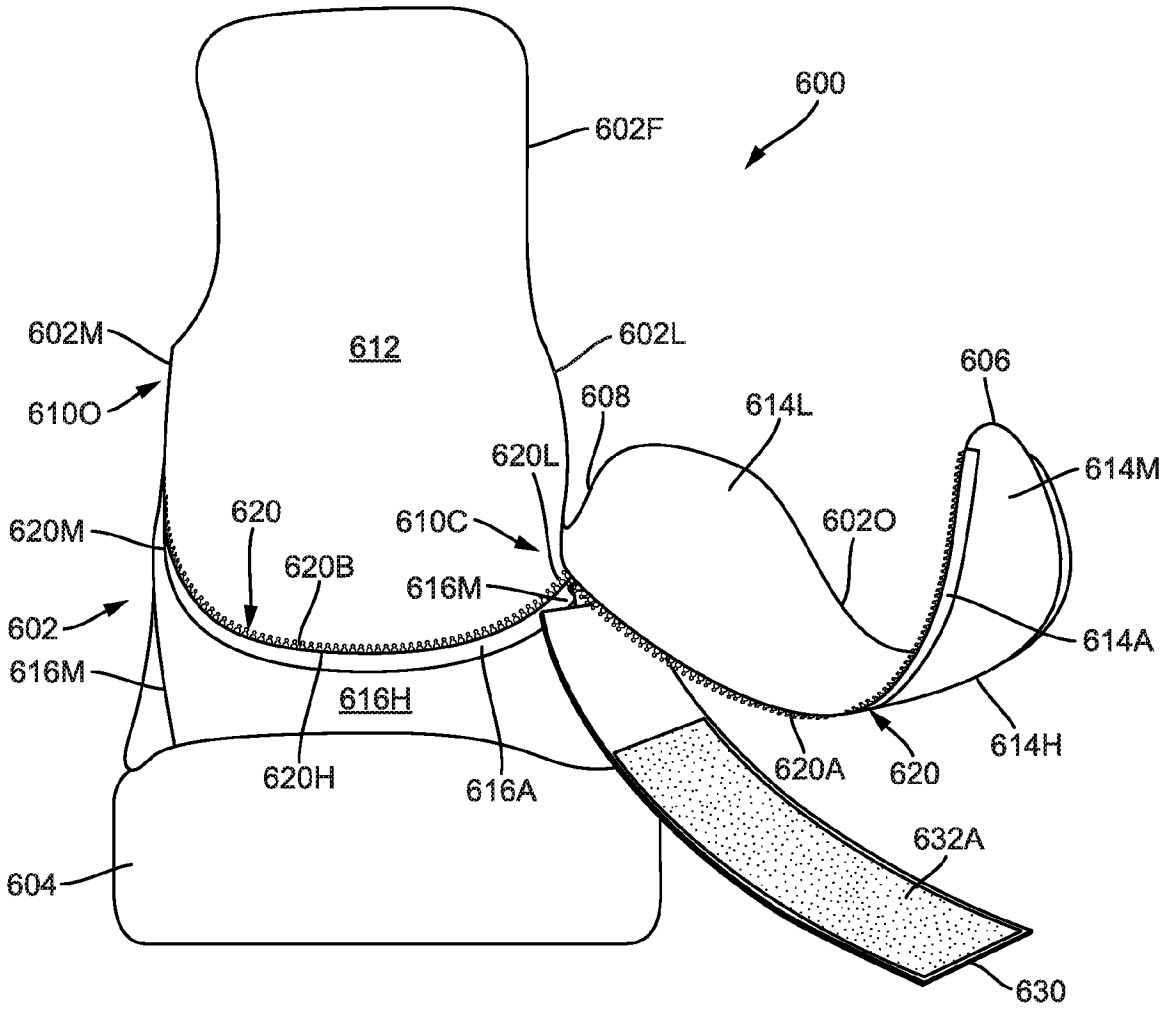
Figure 6I:
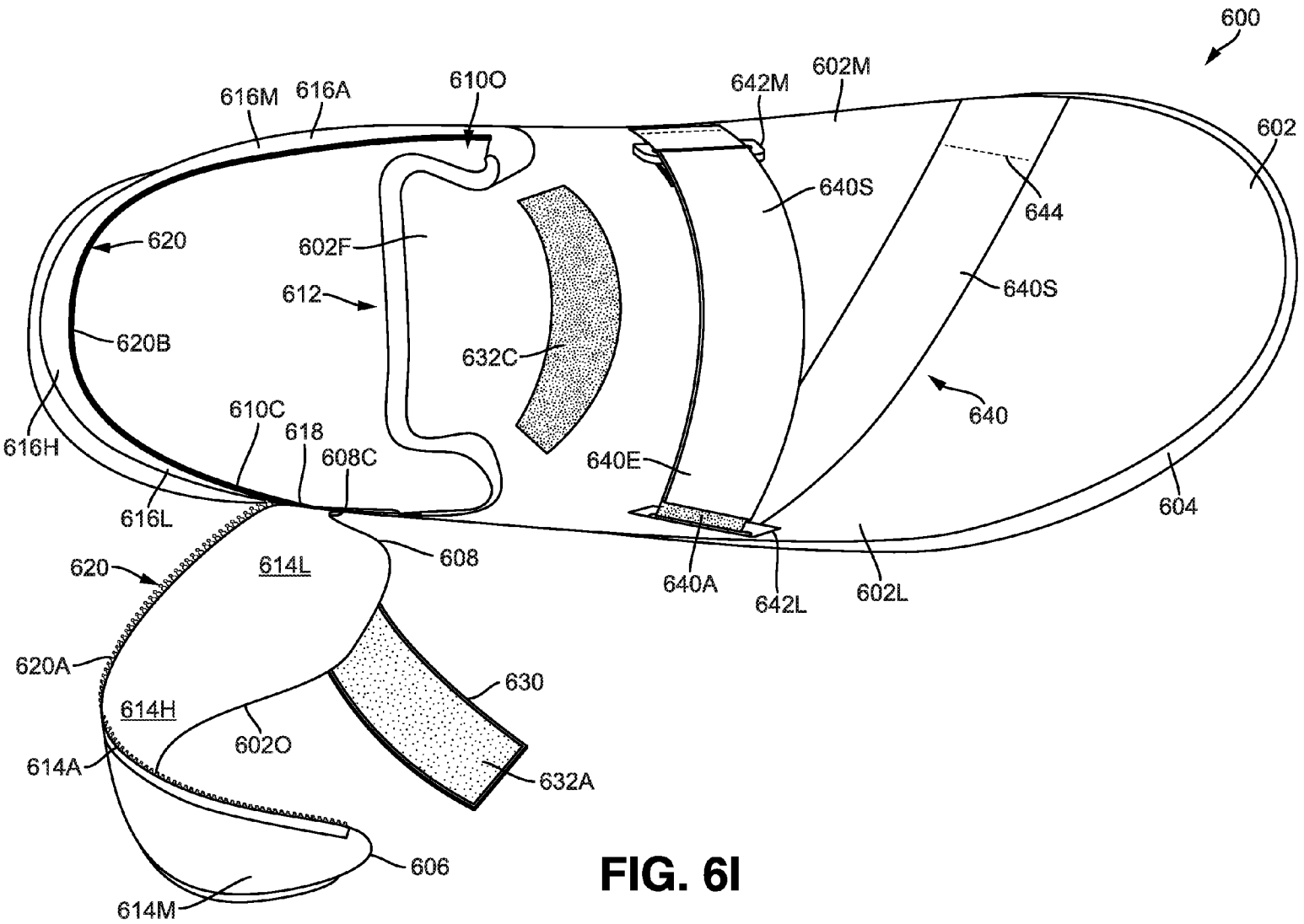

As further shown, for example, in FIGS. 6C and 6H, in this illustrated example, the closure system 620 track (e.g., track portion 620B on the upper base portion 616) includes a first side portion 620M, a rear heel portion 620H, and a second side portion 620L, wherein (with the sole structure 604 supported on a horizontal support surface) a vertically lowest section of the track is located in the rear heel portion 620H of the track. Also, this illustrated track: (a) extends forward to the first side portion 620M in an upward direction from the vertically lowest section in the rear heel portion 620H and (b) extends forward to the second side portion 620L in an upward direction from this vertically lowest section in the rear heel portion 620H. In this manner, when viewed from a top and/or rear point of view, the closure system 620 track (at least in the closed condition, in the foot engaging configuration, and/or as track portion 620B on the upper base portion 616) may have somewhat of an upwardly inclined U-shape around the rear heel area of the upper 602. This feature also is evident, for example, from the side views of FIGS. 6A and 6B.

Articles of footwear 600 in accordance with at least some examples of this invention may include an ankle strap 630, e.g., as at least a portion of a manner for securing the footwear 600 to a wearer's foot. As shown in FIG. 6B, in this illustrated example, the ankle strap 630 is secured to the closure element 622 (e.g., zipper slider) of the closure system 620, and therefore, the ankle strap 630 moves with the closure element 622. Although other options are possible, in this illustrated example, the ankle strap 630 also may function as a "handle" that allows the user to pull the closure element 622 to open and/or close the closure system 620.

In the specific example of FIGS. 6A-6I, the ankle strap 630 includes a portion 632A of a securing system (e.g., a portion of a hook-and-loop type fastener in this example) used to hold the ankle strap 630 around the wearer's ankle, e.g., in a tensioned condition. The ankle strap 630 may include one or more strips or sections of securing element portions 632A that extend over any desired portion or proportion of the strap 630's length. This securing system portion 632A may be used to engage one or more other portions of the securing system. For example, as shown in this illustrated example, the second side 602L of the upper 602 (on the second side 614L of the ankle containing portion 614) has a securing portion 632B or securing member. In operation, when placed in the "closed condition" or "foot engaging configuration," the closure element 622 of the closure system 620 moves to and stops along the track at the first side 602M (and at the first side edge 606 in this example) of the upper 602 and at the first side 616M of the base portion 616 of the upper 602. Then, to secure the closure system 620 in place, the ankle strap 630 is pulled around a front instep or front ankle portion 602F of the upper 602 and is secured to the securing member 632B at the second side 602L of the upper 602. Additionally or alternatively, if desired, a securing portion 632C may be provided on the front instep or front ankle portion 602F of the upper 602, e.g., to allow the strap 630 to be secured at that location (in addition to or in place of the second side 602L securing portion 632B).

As one potential feature in accordance with these aspects of the invention, with the sole structure 604 supported on a horizontal support surface (e.g., as shown in FIG. 6A), the ankle strap 630 may extend to (and be at least partially secured to the upper 602) at a location on the second side 602L of the upper 602 that is more rearward (i.e., toward the rearmost heel location) than a location of the closed end 610C of the foot insertion opening and/or more rearward than the rearmost portion (e.g., side 618A) of the connecting member 618. This feature is illustrated in FIG. 6A by the vertical line VS (showing the rearmost extension and securement location of ankle strap 630) and vertical line VC (showing the rearmost extent and location of the connecting element 618 and/or the vertical location of the closed end 610C of the foot insertion opening). In this orientation, the horizontal distance D between VS and VC may be within the range of 3 mm to 30 mm, and in some examples, from 5 mm to 25 mm, or even from 7 mm to 20 mm. In this manner, a tight and secure fit can be provided that wraps 360° around the wearer's ankle (by ankle containing portion 614 and strap 630).

Other securing system structures, e.g., around a wearer's ankle and/or for an ankle strap, may be provided, if desired, without departing from this invention. Additionally or alternatively, if desired, the various parts, the locations of various parts, and/or the sizes, shapes, and/or styles of the various parts of the ankle securing system (e.g., parts 630, 632A, 632B, 632C, etc.) may vary without departing from this invention.

An additional or alternative foot securing system for at least some examples of this invention is shown in FIGS. 6A-6I as a forefoot and/or midfoot securing system. More specifically, for this securing system a securing strap 640 is provided that extends across a top forefoot and/or top midfoot portion of the upper 602 one or more times. A single securing strap 640 may extend across the top forefoot and/or top midfoot portion of the upper 602 any desired number of times without departing from the invention. Alternatively, if desired, two or more securing straps may be provided that each extends one or more times across the top forefoot and/or top midfoot portion of the upper 602. The more specific example of FIGS. 6A-6I will be described in more detail below.

In this example footwear structure 600, the upper 602 (and/or the sole structure 604) includes a first strap engaging component 642L (e.g., a first tensioning device, such as a tensioning ring) provided at a midfoot portion on the second side 602L of the upper 600 (e.g., included on the upper base portion 616). A second strap engaging component 642M (e.g., a second tensioning device (such as a tensioning ring), a portion of a strap securing system (e.g., a button, a buttonhole, a portion of a buckle, a portion of a snap, a portion of a hook-and-loop fastener, a portion of another mechanical fastener, etc.) is provided at a midfoot portion on the first side 602M of the upper 602 (e.g., included on the upper base portion 616).

The securing strap 640 of this example includes a first strap portion 640F fixed, e.g., at a forefoot portion on the first side 602M of the upper 602. While FIGS. 6B, 6D, 6E, 6G, and 6I show the first strap portion 640F fixed by a sewn seam 644 engaging it to the base portion 616 of the upper 602, other ways of fixing the first strap portion 640F with respect to upper 602 and/or sole structure 604 may be used without departing from this invention, including adhesives or cements, mechanical fasteners (including releasable mechanical fasteners), fixing the first strap portion 640F between the upper 602 and the sole structure 604 at their junction, etc. The first strap portion 640F extends to an area where the strap 640 is not fixed to the upper 602 to provide a flexible strap portion 640S contiguously extending from the first/fixed strap portion 640F. The flexible strap portion 640S extends across the top forefoot/midfoot portion of the upper 602 to the first strap engaging component 642L (e.g., through a ring of a tensioning device) on the second side 602L of the upper 602, and from there to the second strap engaging component 642M located on first side 602M of the upper 602. In this specific illustrated example, the second strap engaging component 642M constitutes a second tensioning device, and the flexible strap portion 640S extends through this second tensioning device, double backs over itself and is secured to itself. This is accomplished by providing a first portion 640A of a securing system (e.g., a portion of a hook-and-loop fastener) on a mid-area of flexible strap portion 640S and a second portion 640B of the securing system (e.g., a mating portion of a hook-and-loop fastener) on the facing surface, e.g., at the free end 640E of the flexible strap portion 640S. As another option, rather than having the free end 640E of flexible strap portion 640S secure to itself, a securing member (akin to 640A) could be provided on the upper 602 (e.g., on the upper base portion 616), and the strap securing member 640B may engage that upper-mounted securing member.

In use, the strap engaging component(s) 642L and/or 642M may be used to apply tension to the strap 640 (e.g., by pulling the flexible strap portion 640S tight through the tensioning devices or other strap engaging component(s) 642L and/or 642M), and the flexible strap portion 640S may be secured in place with respect to the upper 602 and/or sole structure 604 in this tensioned condition by the securing system (e.g., 640A/640B or other type of securing system). In this manner, a tight and secure fit to the wearer's foot can be provided in the forefoot and midfoot areas of the shoe.

In the illustrated example of FIGS. 6A-6I, the upper 602 of the article of footwear 600 can open up very wide, e.g., by moving the ankle containing portion 614 of upper 602 laterally/sideways with respect to the upper base portion 616 and/or the sole structure 604 (e.g., to the lateral side). In effect, the ankle containing portion 614 may move/rotate sideways with respect to the base portion 616 and the sole structure 604 via connecting member 618 (e.g., moving akin to rotation on a hinge type structure) to open in somewhat of a "clamshell" fashion. The rear of the upper base portion 616 in this open condition may appear somewhat as an open backed slipper or "slide" type shoe. These actions and features open the rear heel area of the upper 602 very wide and low and can enable easy insertion of a wearer's foot into the interior chamber 612, generally from the rear of the footwear structure 600. Then, by pulling the ankle strap 630, the upper 602 can be closed and secured.

Various parts/features described above in conjunction with FIGS. 6A-6I use the designators "M" and "L." These designators refer to the "medial side" and "lateral side" of the specifically illustrated example footwear structure 600 (and the "first" side 602M of the illustrated upper 602 corresponds to the medial side and the "second" side 602L of the illustrated upper 602 corresponds to the lateral side). These designators, however, are used only for convenience and to correspond to the illustrated example. Given benefit of this disclosure, those skilled in the art will recognize that the various parts/features identified by the designators "M" and "L" may be provided on the opposite sides of footwear from their "M" and "L" designators (e.g., on the lateral side and medial side, respectively), if desired, without departing from this invention.

Additionally, any one or more features/structures/parts from the embodiments of the invention shown and/or described with respect to in FIGS. 1A-5 may be used in the footwear structure 600 of FIGS. 6A-6I, if desired. Additionally or alternatively, any one or more features/structures/parts from the embodiments of the invention shown and/or described with respect to FIGS. 6A-6I may be used in the footwear structures of FIG. 1A-5. Any combinations or subcombinations of the features/structures/parts from FIGS. 1A through 7D may be used in footwear structures without departing from this invention (and is envisioned as part of this invention).

III. CONCLUSION

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. An article of footwear, comprising:

an upper including a top opening, a first side, a second side, a first side edge extending downward from the top opening at the first side, and a second side edge extending downward from the top opening at the second side, wherein the second side edge includes a downward extending segment and a rearward extending segment, and wherein the upper further includes a foot insertion opening extending from the first side edge and terminating at a closed end located at a side heel area of the upper on the second side of the upper;

a closure system engaged with the upper for releasably closing the foot insertion opening, wherein the closure system extends between the closed end and the first side edge of the upper; and a sole structure engaged with the upper.

2. An article of footwear according to claim 1, further comprising a securing strap engaged with the upper and extending across a top forefoot portion of the upper or a top midfoot portion of the upper one or more times.

3. An article of footwear according to claim 1, wherein the rearward extending segment of the second side edge terminates at a closed end, wherein the closed end of the second side edge is located a distance L from the closed end of the closure system, wherein L is within a range of from 10 mm to 70 mm.

4. An article of footwear according to claim 1, wherein the closure system includes a track extending along the second side of the upper, wherein an end portion of the track along the second side of the upper substantially aligns with an extension direction of the rearward extending segment of the second side edge of the upper.

5. An article of footwear according to claim 1, wherein the rearward extending segment of the second side edge terminates at a closed end, wherein the upper further includes a connecting member extending between the closed end of the foot insertion opening and the closed end of the rearward extending segment of the second side edge, and wherein an ankle containing portion of the upper is movable with respect to a base portion of the upper about the connecting member to change the upper from a foot insertion configuration to a foot engaging configuration.

6. An article of footwear according to claim 5, wherein a length dimension from a first side of the connecting member to a second side of the connecting member is within a range of from 10 mm to 70 mm.

7. An article of footwear according to claim 1, wherein the closure system includes a track extending along the foot insertion opening and a closure element movable along track, wherein the closure element changes the foot insertion opening between an open condition and a closed condition.

8. An article of footwear, comprising:

an upper including a top opening, a first side, a second side, a first side edge extending downward from the top opening at the first side, and a second side edge extending downward from the top opening at the second side, wherein the upper further includes a foot insertion opening extending from the first side edge and terminating at a closed end located at a side heel area of the upper on the second side of the upper;

a closure system engaged with the upper for releasably closing the foot insertion opening, wherein the closure system extends between the closed end and the first side edge of the upper, wherein the closure system includes a track extending along the foot insertion opening and a closure element movable along track, wherein the closure element changes the foot insertion opening between an open condition and a closed condition;

an ankle strap secured to the closure element, wherein the second side of the upper has a securing member, wherein in the closed condition:

the closure element stops along the track at the first side edge of the upper;

the ankle strap extends around a front instep or front ankle portion of the upper and is secured to the securing member at the second side of the upper; and with the sole structure supported on a horizontal support surface, the ankle strap extends to a location on the second side of the upper that is more rearward than a location of the closed end of the foot insertion opening; and a sole structure engaged with the upper.

9. An article of footwear, comprising:

an upper including a top opening, a first side, a second side, a first side edge extending downward from the top opening at the first side, and a second side edge extending downward from the top opening at the second side, wherein the upper further includes a foot insertion opening extending from the first side edge and terminating at a closed end located at a side heel area of the upper on the second side of the upper;

a closure system engaged with the upper for releasably closing the foot insertion opening, wherein the closure system extends between the closed end and the first side edge of the upper, wherein the closure system includes a track extending along the foot insertion opening and a closure element movable along track, wherein the closure element changes the foot insertion opening between an open condition and a closed condition; and a sole structure engaged with the upper, wherein with the sole structure supported on a horizontal support surface, the track includes a first side portion, a rear heel portion, and a second side portion, wherein a vertically lowest section of the track is located in the rear heel portion, wherein the track extends to the first side portion in an upward direction forward from the vertically lowest section, and wherein the track extends to the second side portion in an upward direction forward from the vertically lowest section.

10. An article of footwear according to claim 1, further comprising:

a first strap engaging component including a first tensioning device provided at a midfoot portion on the second side of the upper;

a second strap engaging component provided at a midfoot portion on the first side of the upper; and a securing strap extending across a top forefoot portion of the upper, wherein the securing strap includes a first portion fixed at a forefoot portion on the first side of the upper and a flexible strap portion extending from the first portion, to the first tensioning device, and to the second strap engaging component.

11. An article of footwear, comprising:

a sole structure;

an upper engaged with the sole structure, wherein the upper, at least in part, defines a foot-receiving volume configured to receive a wearer's foot in use, the upper including:

(a) an ankle containing portion including a first side, a rear heel area, and a second side, (b) a base portion including a first side and a second side, and (c) a connecting member connecting the second side of the ankle containing portion and the second side of the base portion, wherein, with the sole structure supported on a horizontal support surface, the upper is changeable by movement of the ankle containing portion with respect to the base portion at the connecting member between: (a) a foot engaging configuration in which the first side of the ankle containing portion of the upper is positioned over the first side of the base portion to close the upper and (b) a foot insertion configuration in which the first side of the ankle containing portion of the upper is positioned sideways outside of the second side of the base portion with respect to the foot-receiving volume of the upper to open a rear heel area of the upper;

a closure system for releasably holding the upper in the foot engaging configuration wherein the closure system engages at least a section of a lower edge of the ankle containing portion with at least a section of an upper edge of the base portion, wherein the closure system includes: (a) a first track portion extending along the section of the lower edge of the ankle containing portion, (b) a second track portion extending along the section of the upper edge of the base portion, and (c) a closure element movable along the section of the first track portion and the section of the second track portion, wherein movement of the closure element changes the upper between the foot engaging configuration and the foot insertion configuration; and an ankle strap secured to the closure element, wherein the second side of the ankle containing portion of the upper has a securing member, and wherein in the foot engaging configuration: (a) the closure element stops at the first side of the base portion of the upper and (b) the ankle strap extends around a front instep or front ankle portion of the upper and is secured to the securing member.

12. An article of footwear according to claim 11, wherein the ankle containing portion of the upper includes:

a top edge, a first edge extending from the top edge, along the first side of the ankle containing portion, around the rear heel area of the ankle containing portion, to the second side of the ankle containing portion, and to a first side of the connecting member, wherein a portion of the first edge constitutes the lower edge of the ankle containing portion of the upper, and a second edge extending from the top edge, along the second side of the ankle containing portion, and to a second side of the connecting member.

13. An article of footwear according to claim 12, wherein the second edge of the ankle containing portion includes a downward extending segment and a rearward extending segment that extends to the second side of the connecting member.

14. An article of footwear according to claim 13, wherein a length dimension from the first side of the connecting member to the second side of the connecting member is within a range of from 10 mm to 70 mm.

15. An article of footwear according to claim 11, wherein the ankle strap extends to a location on the second side of the ankle containing portion that is more rearward than the connecting member.

16. An article of footwear, comprising:

a sole structure;

an upper engaged with the sole structure, wherein the upper, at least in part, defines a foot-receiving volume configured to receive a wearer's foot in use, the upper including:

(a) an ankle containing portion including a first side, a rear heel area, and a second side, (b) a base portion including a first side and a second side, and (c) a connecting member connecting the second side of the ankle containing portion and the second side of the base portion, wherein, with the sole structure supported on a horizontal support surface, the upper is changeable by movement of the ankle containing portion with respect to the base portion at the connecting member between: (a) a foot engaging configuration in which the first side of the ankle containing portion of the upper is positioned over the first side of the base portion to close the upper and (b) a foot insertion configuration in which the first side of the ankle containing portion of the upper is positioned sideways outside of the second side of the base portion with respect to the foot-receiving volume of the upper to open a rear heel area of the upper; and a closure system for releasably holding the upper in the foot engaging configuration, wherein the closure system engages at least a section of a lower edge of the ankle containing portion with at least a section of an upper edge of the base portion, wherein the closure system includes a track having a first side portion, a rear heel portion, and a second side portion, wherein a vertically lowest section of the track is located in the rear heel portion, wherein the first side portion of the track extends toward the first side of the base portion of the upper in an upward direction forward from the vertically lowest section, and wherein the second side portion of the track extends toward the second side of the base portion of the upper in an upward direction forward from the vertically lowest section.

17. An article of footwear according to claim 16, wherein a length dimension from a first side of the connecting member to a second side of the connecting member is within a range of from 10 mm to 70 mm.

18. An article of footwear according to claim 11, further comprising:

a first strap engaging component provided at a midfoot portion on the second side of the base portion of the upper;

a second strap engaging component provided at a midfoot portion on the first side of the base portion of the upper; and a securing strap extending across a top forefoot portion of the upper, wherein the securing strap includes a first portion fixed at a forefoot portion on the first side of the upper and a flexible strap portion extending from the first portion, to the first strap engaging component, and to the second strap engaging component.

19. An article of footwear according to claim 18, wherein the first strap engaging component is a first tensioning device, wherein the second strap engaging component is a second tensioning device, and wherein the securing strap includes a securing member for holding the securing strap in a tensioned condition.

20. An article of footwear according to claim 11, wherein a length dimension from a first side of the connecting member to a second side of the connecting member is within a range of from 10 mm to 70 mm.

* * * * *